US011795024B2

(12) United States Patent
Fujikake et al.

(10) Patent No.: US 11,795,024 B2
(45) Date of Patent: Oct. 24, 2023

(54) PRINTING APPARATUS

(71) Applicant: CANON KABUSHIKI KAISHA, Tokyo (JP)

(72) Inventors: Akira Fujikake, Kanagawa (JP); Tomohiro Suzuki, Kanagawa (JP); Waichiro Saiki, Kanagawa (JP); Ryo Kobayashi, Kanagawa (JP); Takeshi Koda, Kanagawa (JP); Toshiro Sugiyama, Kanagawa (JP); Tomoyuki Nagase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 17/484,421

(22) Filed: Sep. 24, 2021

(65) Prior Publication Data

US 2022/0097995 A1 Mar. 31, 2022

(30) Foreign Application Priority Data

Sep. 30, 2020 (JP) ..... 2020-166112

(51) Int. Cl.

| | |
|---|---|
| ***B65H 29/58*** | (2006.01) |
| ***B41J 11/00*** | (2006.01) |
| ***B65H 16/00*** | (2006.01) |
| ***B65H 29/36*** | (2006.01) |
| ***B65H 29/60*** | (2006.01) |

(52) U.S. Cl.

CPC ..... *B65H 29/58* (2013.01); *B41J 11/0045* (2013.01); *B65H 16/005* (2013.01); *B65H 29/36* (2013.01); *B65H 29/60* (2013.01); *B65H 2511/214* (2013.01); *B65H 2701/11312* (2013.01)

(58) Field of Classification Search

CPC ..... B41J 11/0045; B65H 2701/11312; B65H 2511/214; B65H 16/005; B65H 29/36; B65H 29/58; B65H 29/60; B65H 29/245; B65H 29/246; B65H 29/247; B65H 29/34; B65H 29/38; B65H 29/44; B65H 29/46

See application file for complete search history.

(56) References Cited

U.S. PATENT DOCUMENTS

| | | | | |
|---|---|---|---|---|
| 6,908,078 | B2 | 6/2005 | Suzuki et al. | |
| 7,172,186 | B2 * | 2/2007 | Saito | B65H 29/38 270/58.11 |
| 7,354,034 | B2 | 4/2008 | Nakamura et al. | |

(Continued)

FOREIGN PATENT DOCUMENTS

JP 2016-069137 A 5/2016

*Primary Examiner* — Leslie A Nicholson, III

(74) *Attorney, Agent, or Firm* — Venable LLP

(57) ABSTRACT

A printing apparatus comprises a sheet eject tray; a movable guide arranged on an upstream side of the sheet eject tray with respect to a direction of conveyance of a sheet and being configured to be able to move to a protruding position and a retracted position; and a driving mechanism configured to cause the movable guide to move to the protruding position when a leading edge of a sheet is conveyed along the movable guide and cause the movable guide to move to the retracted position when a trailing edge of a sheet is conveyed along the movable guide, wherein the protruding position includes a first position at which the movable guide presses a sheet to the sheet eject tray and a second position between the first position and the retracted position.

20 Claims, 20 Drawing Sheets

(56) References Cited

U.S. PATENT DOCUMENTS

| | | | | |
|---|---|---|---|---|
| 7,690,636 | B2 * | 4/2010 | Noh | G03G 15/6573 270/58.11 |
| 8,899,579 | B2 * | 12/2014 | Gamo | B65H 31/34 271/220 |
| 8,915,492 | B2 * | 12/2014 | Sugiyama | B42C 1/12 271/220 |
| 8,955,838 | B2 * | 2/2015 | Saito | B65H 31/32 271/189 |
| 9,988,231 | B2 * | 6/2018 | Nakano | B65H 29/54 |
| 10,150,637 | B2 | 12/2018 | Wakayama et al. | |
| 10,287,127 | B2 * | 5/2019 | Okada | B65H 31/10 |
| 10,604,371 | B2 * | 3/2020 | Kotani | B65H 29/70 |
| 10,822,192 | B2 * | 11/2020 | Kotani | B65H 43/08 |
| 11,027,937 | B2 * | 6/2021 | Fukasawa | B65H 29/60 |
| 11,274,008 | B2 * | 3/2022 | Okada | B65H 43/00 |
| 2016/0090262 | A1 | 3/2016 | Wakayama et al. | |

* cited by examiner

FIG. 16

| NAME OF TYPE OF PAPER | INK FIXABILITY | INK DISCHARGING MODE = DARK | INK DISCHARGING MODE = LIGHT |
|---|---|---|---|
| PLAIN PAPER A | GOOD | SELECT SHEET EJECT SEQUENCE A | SELECT SHEET EJECT SEQUENCE A |
| PLAIN PAPER B | NORMAL | SELECT SHEET EJECT SEQUENCE B Tc=3.0 SECS | SELECT SHEET EJECT SEQUENCE A |
| LED SHEET A | POOR | SELECT SHEET EJECT SEQUENCE B Tc=5.0 SECS | SELECT SHEET EJECT SEQUENCE B Tc=1.0 SEC |

PRINTING APPARATUS

BACKGROUND OF THE INVENTION

Field of the Invention

The present invention relates to a printing apparatus having a sheet stacker on which ejected sheets are to be stacked.

Description of the Related Art

Normally, in large-format ink-jet printers, a roll sheet is used as a print medium. The roll sheet is ejected after printing is performed, and the ejected print product is contained in a basket arranged in the lower portion of the printer. However, there is a limit to the storage capacity of the basket, and also, the next print product is stacked on a print product that has curled due to the curl of the roll sheet. Accordingly, it was not suitable for large-volume stacking due to problems such as susceptibility to damage and folds and difficulty in retrieval. In recent years, large-format stackers that deal with the above problem have appeared due to an increased demand for large-volume stacking.

Apparatuses that comprise, as such a type of stacker, an eject unit for ejecting a print product and stack the print product ejected by the eject unit onto a stacking tray positioned on the downstream side of the direction of conveyance of the eject unit are known. The stacking tray on which print products are to be stacked is positioned so as to be one level lower than the eject unit on the upstream side with respect to the direction of conveyance in order to stack a plurality of print products and, from there, is angled upward toward the downstream side with respect to the direction of conveyance. A print product conveyed by the eject unit drops onto the tray and is stacked once the trailing edge of the print product leaves the nip of the eject unit.

In a case where print products are to be stacked, if a print product ejected onto the stacking tray is curled, there are cases where that curled print product is pushed out from the stacking tray by a newly ejected print product. In order to deal with this, Japanese Patent Laid-Open No. 2016-69137, for example, by pressing the trailing edge of a print product with a pressing member, makes it possible to prevent the stacked print product, even if it is curled, from being pushed in the conveyance direction at the time of ejection of the next print product and to stack the print products in alignment.

However, with the configuration disclosed in Japanese Patent Laid-Open No. 2016-69137, in a case where printing is performed onto a sheet with poor ink fixability and that sheet is stacked onto the stacking tray, there are cases where, by pressing the trailing edge of the print product ejected onto the stacking tray, ink is transferred between sheets or onto the stacking tray. As a countermeasure to this problem, in order to prevent transferring of ink, it is conceived to set aside time to dry the ink from when a sheet is ejected onto the stacking tray to when the trailing edge is pressed. However, when time for drying is set aside as described above, in a case where a print product is curled or the like, there are cases where the trailing edge of the print product contacts a sheet eject roller, whereby the sheet is pushed out or is damaged.

SUMMARY OF THE INVENTION

The present invention is made in light of the problems described above, and provides a printing apparatus capable of improving the quality of a stacked sheet in a case where a printed sheet is stacked onto a stacking tray.

According to an aspect of the present invention, there is provided a printing apparatus comprising: a sheet eject tray; a movable guide arranged on an upstream side of the sheet eject tray in a direction of conveyance of a sheet and configured to be able to move to a protruding position at which the movable guide is protruded to a side of the sheet eject tray and a retracted position in which the movable guide is retracted to the upstream side from the protruding position; and a driving mechanism configured to cause the movable guide to move to the protruding position when a leading edge of a sheet is conveyed along the movable guide and cause the movable guide to move to the retracted position when a trailing edge of a sheet is conveyed along the movable guide, wherein the protruding position includes a first position at which the movable guide presses a sheet to the sheet eject tray and a second position between the first position and the retracted position.

Further features of the present invention will become apparent from the following description of exemplary embodiments with reference to the attached drawings.

BRIEF DESCRIPTION OF THE DRAWINGS

FIG. 16 is a view illustrating conditions for selecting a sheet eject sequence that accords with the paper type and printing mode.

DESCRIPTION OF THE EMBODIMENTS

Figure 1:
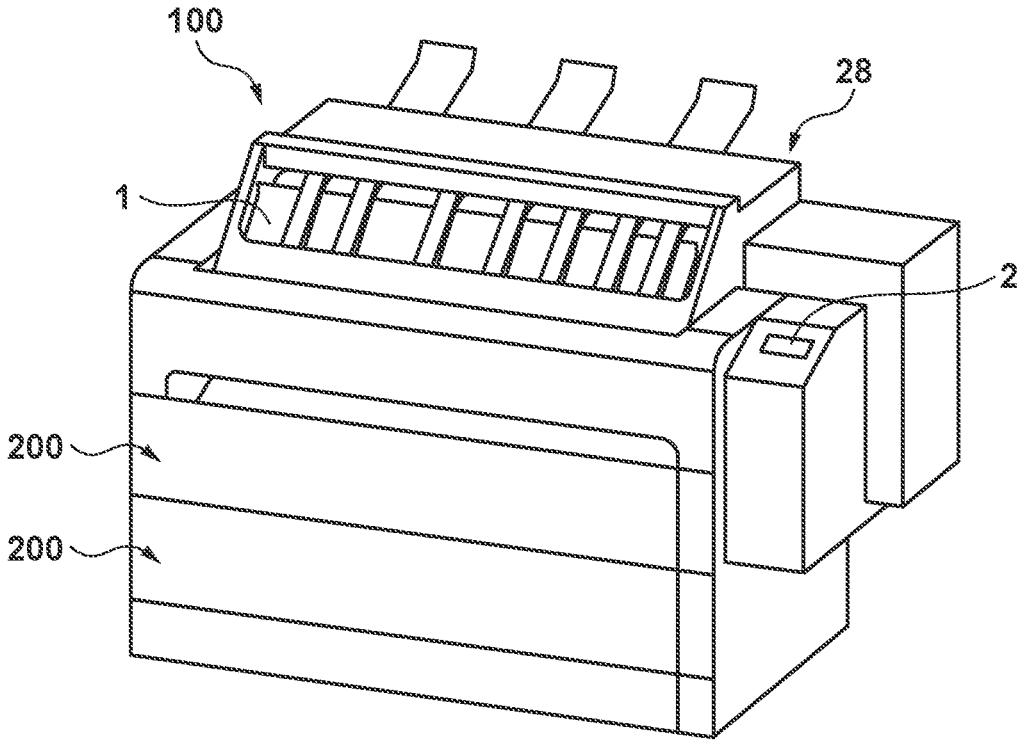
FIG. 1 is a perspective view of a printing apparatus during upper face sheet ejection in an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

FIG. 1 to FIG. 5 are views illustrating a configuration of an ink-jet printing apparatus that is an embodiment of a printing apparatus of the present invention. The printing apparatus of the present embodiment comprises a sheet supply apparatus for supplying a sheet serving as a print medium, a printing unit for printing an image onto that sheet, and a sheet eject unit for selectively ejecting that sheet to two locations, which are a printing apparatus upper face portion and a printing apparatus front face portion.

FIG. 1 is a schematic view of a printing apparatus 100 during upper face sheet ejection and in which two roll sheets, which are sheets 1 wound into a rolled shape, can be set. An image is printed onto the sheet 1 that has been selectively pulled out from either of the two roll sheets set in sheet supply apparatuses 200 positioned one above the other. The sheet on which printing has been completed is ejected onto a stacker 28 arranged on an upper portion of the printing apparatus. A user can input various commands and the like related to the printing apparatus 100 such as size designation of the sheet 1, switching of online/offline, and setting of sheet eject destination using various switches and the like arranged on an operation panel 2.

Figure 2:
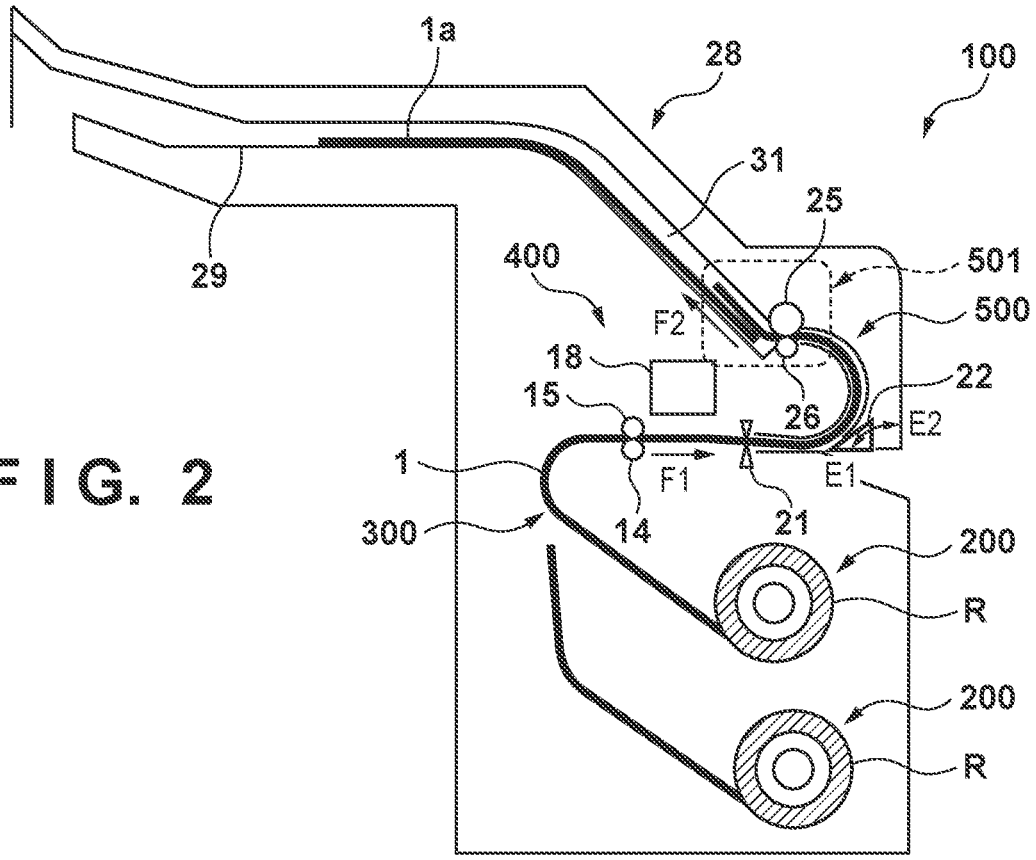
FIG. 2 is a view describing a conveyance path of a sheet in the printing apparatus during upper face sheet ejection.

FIG. 2 is a schematic cross-sectional view of the main parts of the printing apparatus 100 during upper face sheet ejection. Two sheet supply apparatuses 200 that support two rolls R are positioned one above the other. The sheet 1 pulled out from a roll R by a sheet supply apparatus 200 is conveyed along a sheet conveyance path by a sheet conveyance unit (conveyance mechanism) 300 to a printing unit 400, which can print images. The printing unit 400 prints an image onto the sheet 1 by discharging ink from an ink-jet-type printhead 18. The printhead 18 discharges ink from a discharging port using a discharge energy generating element such as an electrothermal transducing element (heater) or a piezoelectric element. The printhead 18 is not limited to only that of an ink-jet method, and the print method of the printing unit 400 is also not limited. For example, it may be a serial scan method, a full-line method, or the like. In a case where it is the serial scan method, an image is printed in conjunction with an operation for conveying the sheet 1 and scanning of the printhead 18 in a direction that intersects the direction of conveyance of the sheet 1. In a case where it is the full-line method, an image is printed using a long printhead 18 extending in a direction that intersects the direction of conveyance of the sheet 1 while the sheet 1 is continuously conveyed.

The sheet 1 guided to the printing unit 400 is conveyed by a conveyance roller 14 in a conveyance direction indicated by an arrow F1. A nip roller (driven roller) 15 facing the conveyance roller 14 can be driven to rotate following the rotation of the conveyance roller 14. A cutter 21 is positioned on the downstream side of the printhead 18 in the conveyance direction (direction of the arrow F1) and cuts the sheet 1 by operating at the time of end of printing. Further on the downstream side of the cutter 21 is positioned a sheet eject switching flap 22 that can rotate in a direction of arrows E1 and E2 in the figure, and the position thereof is switched based on control by a CPU 201 (refer to FIG. 5). The sheet eject switching flap 22, during upper face sheet ejection, is positioned at a position in which it has been rotated in the direction of the arrow E1. The sheet 1 that has passed the sheet eject switching flap 22 is ejected by an upper face sheet eject unit 500 onto the stacker 28 provided in the upper portion of the printing unit 400. Between the upper face sheet eject unit 500 and the stacker 28 is comprised a sheet eject roller 25 and a sheet eject nip roller (driven roller) 26, and they eject the cut sheet 1 in a sheet eject direction indicated by an arrow F2 by gripping it. The ejected sheet 1 is contained in the stacker 28 and is stacked onto a tray (sheet eject tray) 29 and on top of a stacked sheet 1*a*.

Figure 3:
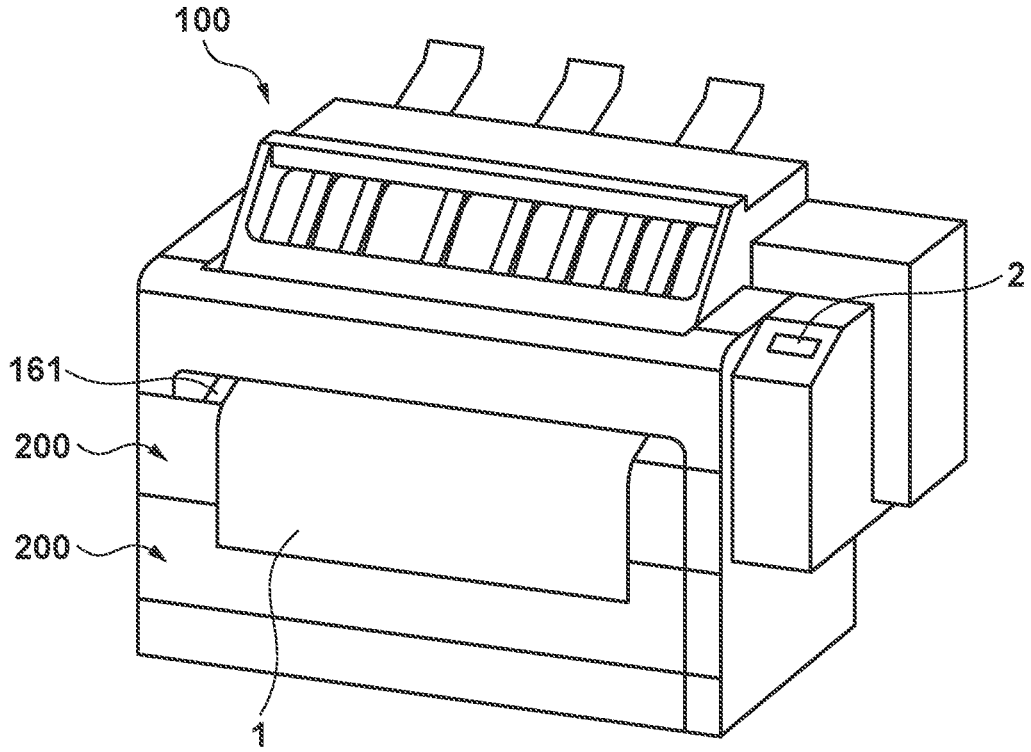
FIG. 3 is a perspective view of a printing apparatus during front face sheet ejection in the embodiment.
Figure 4:
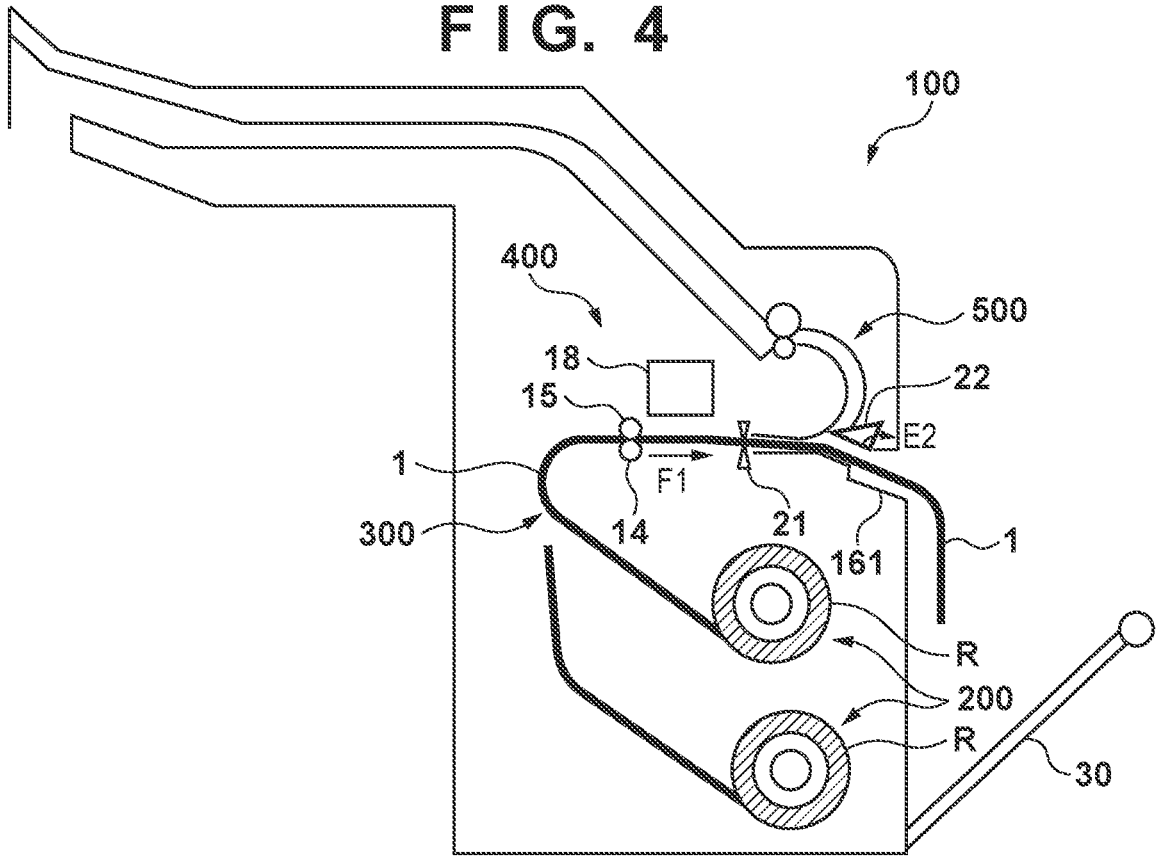
FIG. 4 is a view describing a conveyance path of a sheet in the printing apparatus during front face sheet ejection.

FIG. 3 is a schematic view of the printing apparatus 100 during front face sheet ejection. The sheet 1 on which printing has been completed is ejected from a front face sheet eject supporting unit 161 arranged in a front face portion of the printing apparatus 100. FIG. 4 is a schematic cross-sectional view of the main parts of the printing apparatus 100 during front face sheet ejection. The sheet eject switching flap 22 positioned on the downstream side of the cutter 21 is positioned at a position in which it has been rotated in the direction of the arrow E2. The sheet 1 that has passed the sheet eject switching flap 22 passes above the front face sheet eject supporting unit 161 and then is ejected to the front face of the printing apparatus 100. The sheet 1 that has been cut after printing has been completed is ejected using the weight of the sheet 1 itself and is contained in a front face sheet eject containing unit 30 that can be pulled out from the lower portion of the printer.

Figure 5:
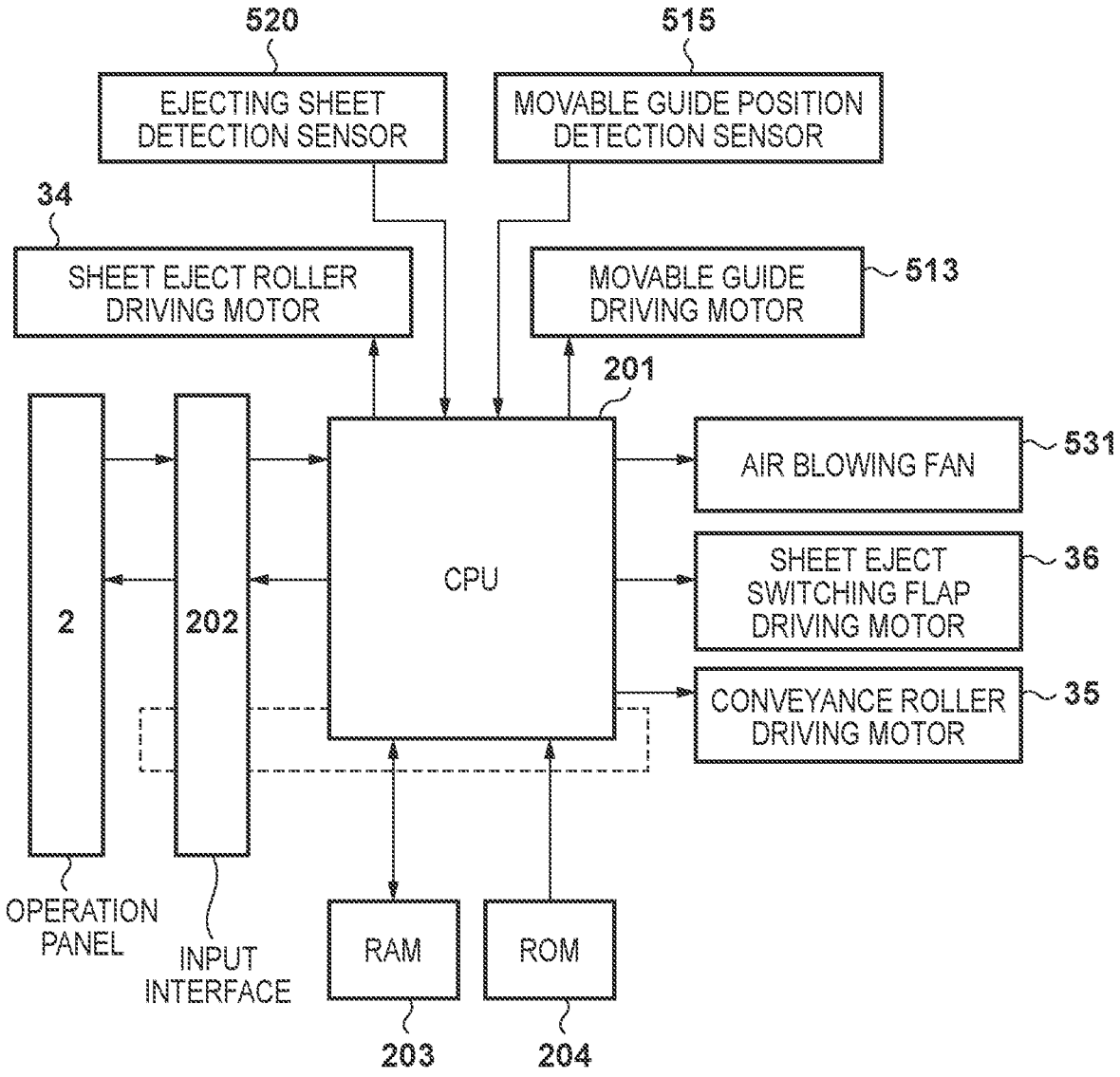
FIG. 5 is a block diagram illustrating a configuration of a control unit of the printing apparatus in the embodiment.

FIG. 5 is a block diagram for describing an example of a configuration of a control system in the printing apparatus 100. The CPU 201 controls each unit of the printing apparatus 100, which includes the sheet supply apparatuses 200, a sheet conveyance unit 300, the printing unit 400, and the upper face sheet eject unit 500, in accordance with a control program stored in a ROM 204. The type and width of sheet 1, various kinds of setting information, and the like are inputted via an input interface 202 from the operation panel 2 into the CPU 201. Also, the CPU 201 performs writing and readout of, for example, information related to the sheet 1 to and from a RAM 203. A sheet eject roller driving motor 34 is a motor for causing forward rotation and reverse rotation of the sheet eject roller 25. A conveyance roller driving motor 35 is a motor for causing forward rotation and reverse rotation of the conveyance roller 14. A sheet eject switching flap driving motor 36 rotates the sheet eject switching flap to the direction indicated by the arrow E1 or the direction indicated by the arrow E2.

Next, the detailed configuration and operation of the upper face sheet eject unit in the printing apparatus 100 will be described.

Figure 6:
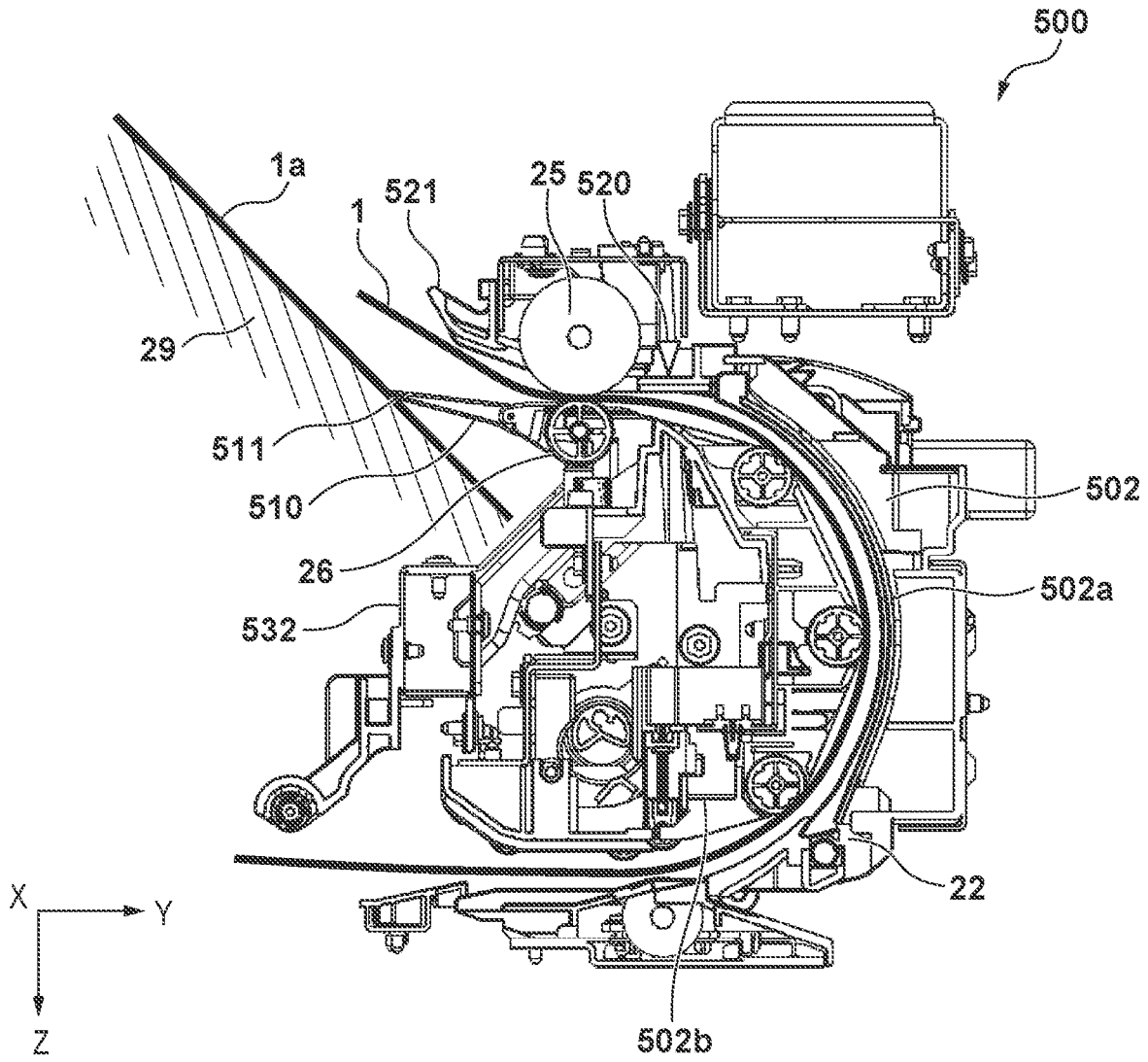
FIG. 6 is a cross-sectional view of an upper face sheet eject unit seen from the side.

FIG. 6 is a cross-sectional view illustrating the detailed configuration of the upper face sheet eject unit 500. The sheet 1 passes a semicircular upper face sheet eject path 502 inside the upper face sheet eject unit 500 and then reaches a tray 29. In printing apparatuses that perform high-speed ejection, printing of the next sheet is performed during a sheet eject operation.

The printing apparatus 100 of the present embodiment has movable guides 510 for pressing the trailing edge of the stacked sheet 1*a* and presses the trailing edge of the stacked sheet 1*a* during the sheet eject operation. The movable guides 510 temporarily retract from the stacked sheet 1*a* after the sheet 1 has been ejected onto the tray 29 and, before the next sheet is ejected, is made to protrude in order to press the trailing edge of the sheet 1 (stacked sheet 1*a*) again. A protruded movable guide 510 and the stacked sheet 1*a* contact at a contact point 511, and at this point, the stacked sheet 1*a* is pressed to the tray 29 by pressure. This makes it possible to prevent the stacked sheet 1*a* stacked on the tray 29 from curling and secure a path for ejecting the next sheet 1 to be ejected from the sheet eject roller 25 and the sheet eject nip roller 26. Also, at the same time, it is possible to prevent the deterioration of alignment performance in the tray 29 caused by the stacked sheet 1*a* being misaligned in the direction of movement of the sheet 1 due to friction when the stacked sheet 1*a* on the tray 29 and the sheet 1 being ejected contact.

The movable guides 510 are switched between a protruding state and a retracted state by the CPU 201 driving a movable guide driving motor 513. The upper face sheet eject path 502 is formed by an upper face sheet eject outer guide 502*a* and an upper face sheet eject inner guide 502*b*, and the movable guides 510 are positioned so as to approximately fit within the upper face sheet eject inner guide 502*b*.

Figure 7A:
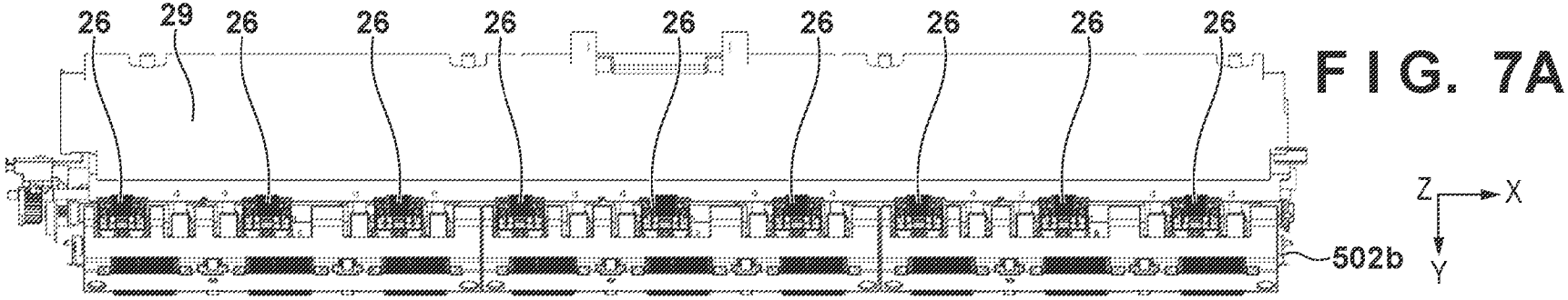
FIGS. 7A-7C are top views of the upper face sheet eject unit whose movable guides are in a retracted state.
Figure 7B:
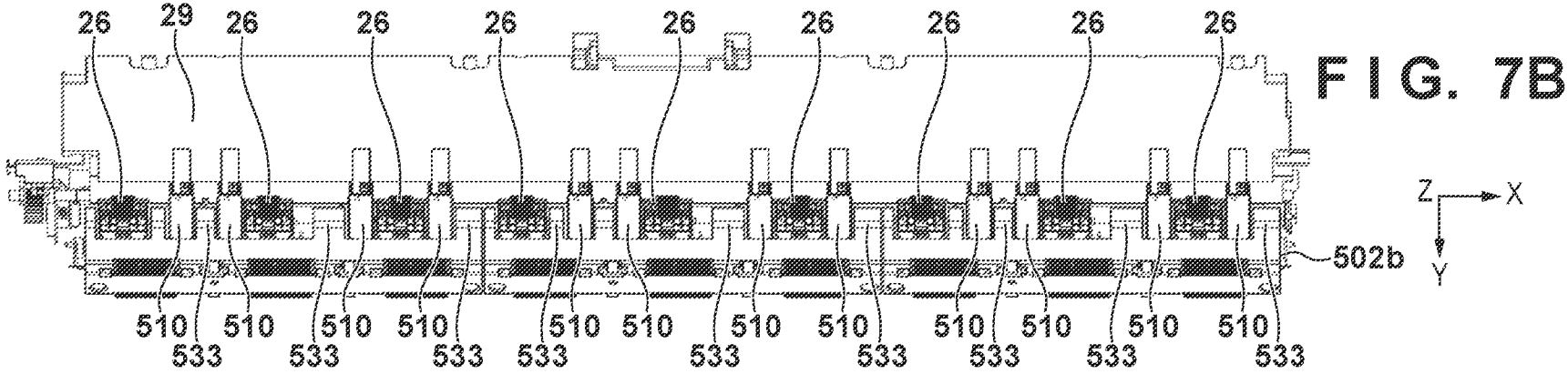
Figure 7C:
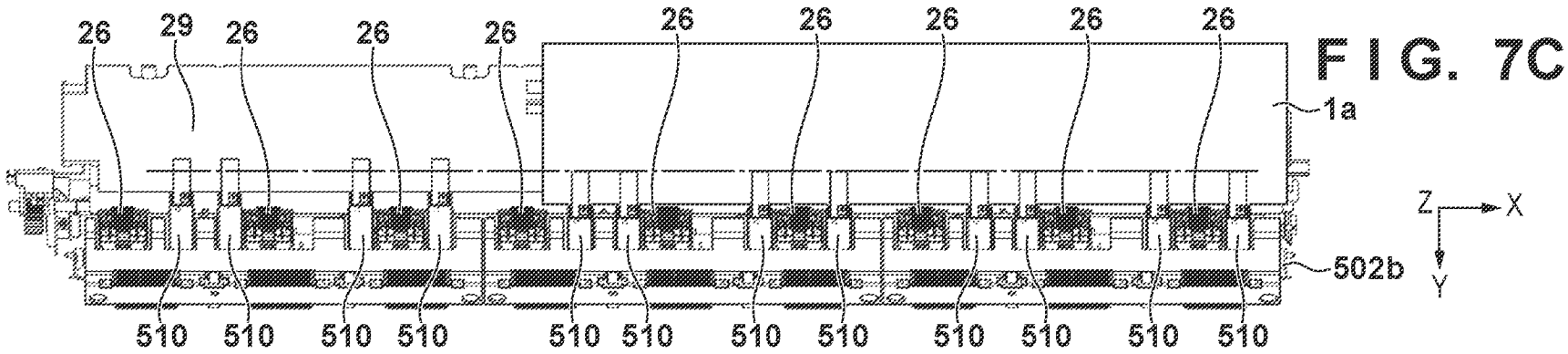

FIGS. 7A to 7C are configuration diagrams of the upper face sheet eject inner guide 502*b* and the tray 29 in X and Y direction when FIG. 6 has been overlooked in a Z-axis direction.

FIG. 7A illustrates the movable guides 510 in a retracted state. FIG. 7B illustrates a state in which the movable guides 510 are in a protruding state and there is no stacked sheet 1*a* on the tray 29. FIG. 7C illustrates a state in which the movable guides 510 are in a protruding state and a stacked sheet 1*a* is stacked on the tray 29.

As illustrated in FIG. 7B, a plurality of sheet eject nip rollers 26, movable guides 510, and air blowing ports 533 are positioned such that their topology is staggered in an X-axis direction. The plurality of movable guides 510 are configured to be able to move independently of each other. Also, in FIG. 7C, a state in which, compared to the movable guides 510 up to the eighth one from the right in an X-axis direction and in a state in which they are pressing the stacked sheet 1*a*, the remaining movable guides 510 that are not pressing the stacked sheet 1*a* are more protruded is illustrated. As described above, by causing the plurality of the movable guides 510 to be independent of each other, the relation between the width of the stacked sheet 1*a* and the total force with which the movable guides 510 press the stacked sheet 1*a* are such that the total force increases in accordance with an increase in width. Accordingly, it is possible to set the pressing force per movable guide 510 to a relatively weak and constant force, whereby it becomes possible to decrease the risk of damage and the like by the pressing force.

Figure 8A:
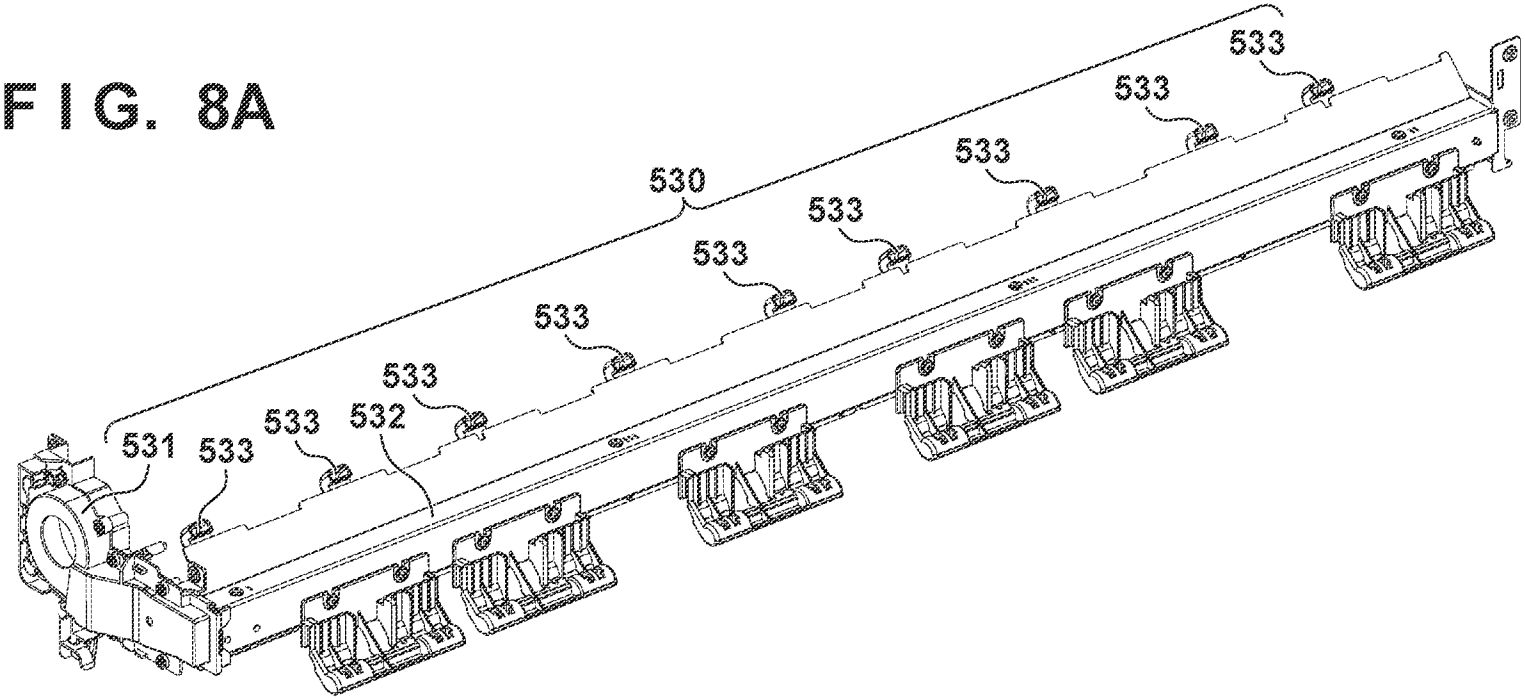
FIGS. 8A and 8B are schematic views of an air blowing mechanism.

Next, the detailed configuration of an air blowing mechanism 530 will be described with reference to FIGS. 8A and 8B. FIG. 8A is a schematic view of the air blowing mechanism 530. The air blowing mechanism 530 comprises an air blowing fan 531, and the air from the air blowing fan 531 is shared by and ejected from the air blowing ports 533, which have been provided in a plurality, via an air blowing duct 532 extending in the width direction of the printing apparatus 100.

Here, the number and position of air blowing fans are not limited; for example, configuration may be taken so as to send the air of a plurality of air blowing fans to one air blowing duct and then eject it from air blowing ports. In the present embodiment, the wind speed from the air blowing ports 533 is approximately 6.0 m/s directly below the air blowing ports 533; however, the wind speed is also not limited. If the sheet 1 floats in a stable manner, the wind speed does not have to be this. Also, the blowing speed is not limited to a constant value; for example, by making the operational duty of an air blowing fan changeable, a mechanism for changing an amount of blown air in accordance with the sheet type of sheet 1 or printing content may be arranged.

Figure 8B:
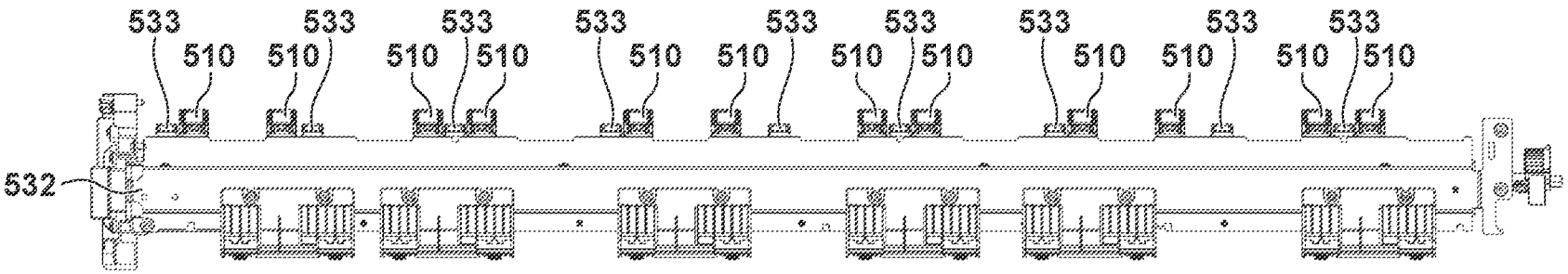

FIG. 8B is a view illustrating a positional relationship between the air blowing mechanism 530 and the movable guides 510. The movable guides 510 are positioned in the width direction in consideration of the sheet width of the ejected sheet 1; accordingly, the air blowing ports 533 are respectively comprised in the vicinity of the movable guides 510. This makes it possible to effectively cause the ejected sheet to float.

Figure 9:
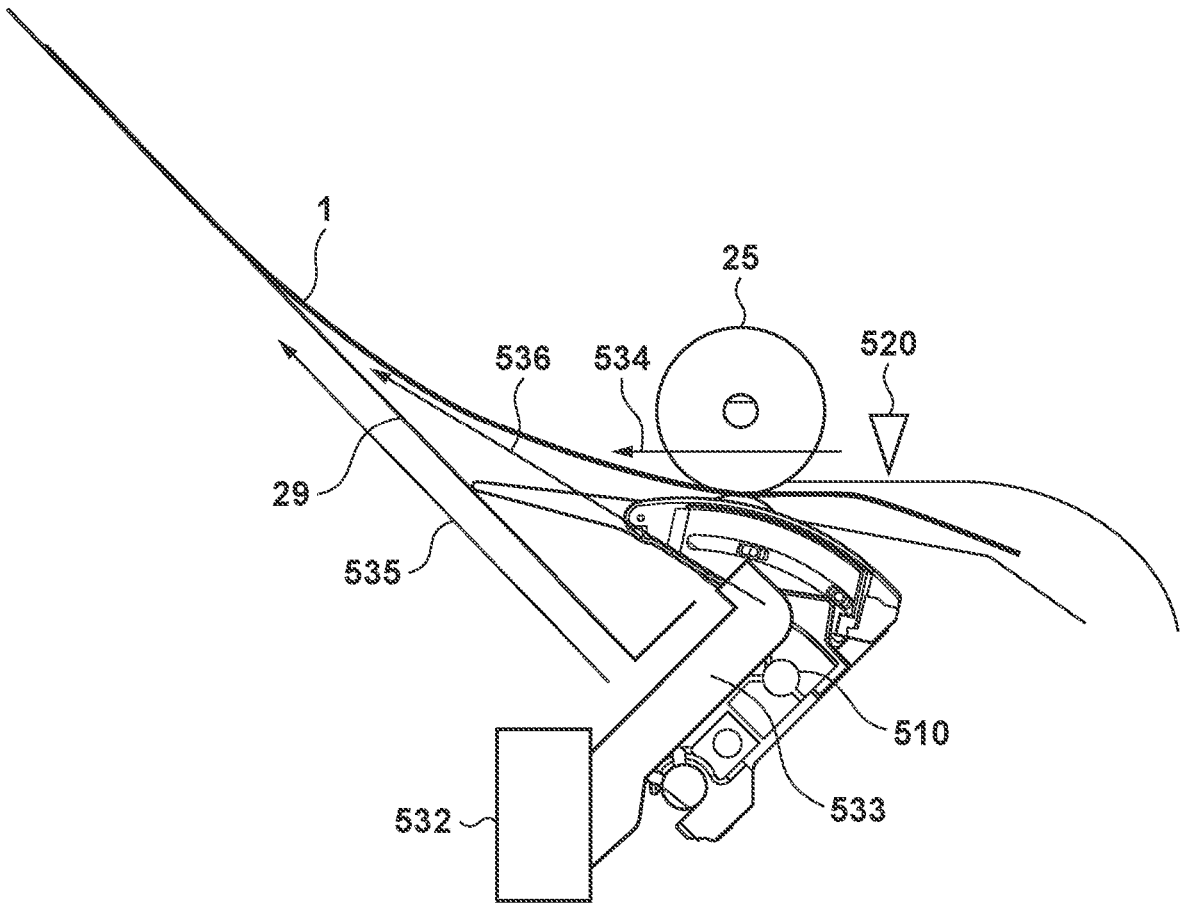
FIG. 9 is a schematic view of a peripheral portion of an air blowing port and an eject roller.

FIG. 9 is a schematic view of mechanisms in the periphery of the sheet eject roller 25 of the upper face sheet eject unit 500. An air blowing port 533 is positioned between the sheet 1 that has passed through the sheet eject roller 25 and a sheet eject nip roller 26, and the tray 29. The sheet 1 ejected from the sheet eject roller 25 is conveyed and then stacked onto the tray 29 in a state in which contact pressure with the tray 29 has been reduced by air blown from the air blowing port 533.

A third direction 536, which is a direction of the air blown from the air blowing port 533, is at an angle between a first direction 534 in which the sheet 1 is to be ejected from the sheet eject roller 25 and a second direction 535 in which the sheet 1 is to be stacked onto the tray 29.

The third direction 536 is a direction that connects the point at which the sheet 1 and the tray 29 contact and the air blowing port 533. Regarding the first direction 534 and the second direction 535, their extended lines intersect at a roughly 45-degree angle. However, the angle between the tray 29 (second direction 535) and a direction in which the sheet eject roller 25 conveys (first direction 534) are not limited to 45° and may be greater or lesser than 45°. In such a case, arranging a mechanism for adjusting the angle of the air blowing mechanism 530 makes it possible to adjust the third direction, whereby it becomes possible to blow air in the optimal direction in accordance with the type and length of the ejected sheet 1.

Figure 10:
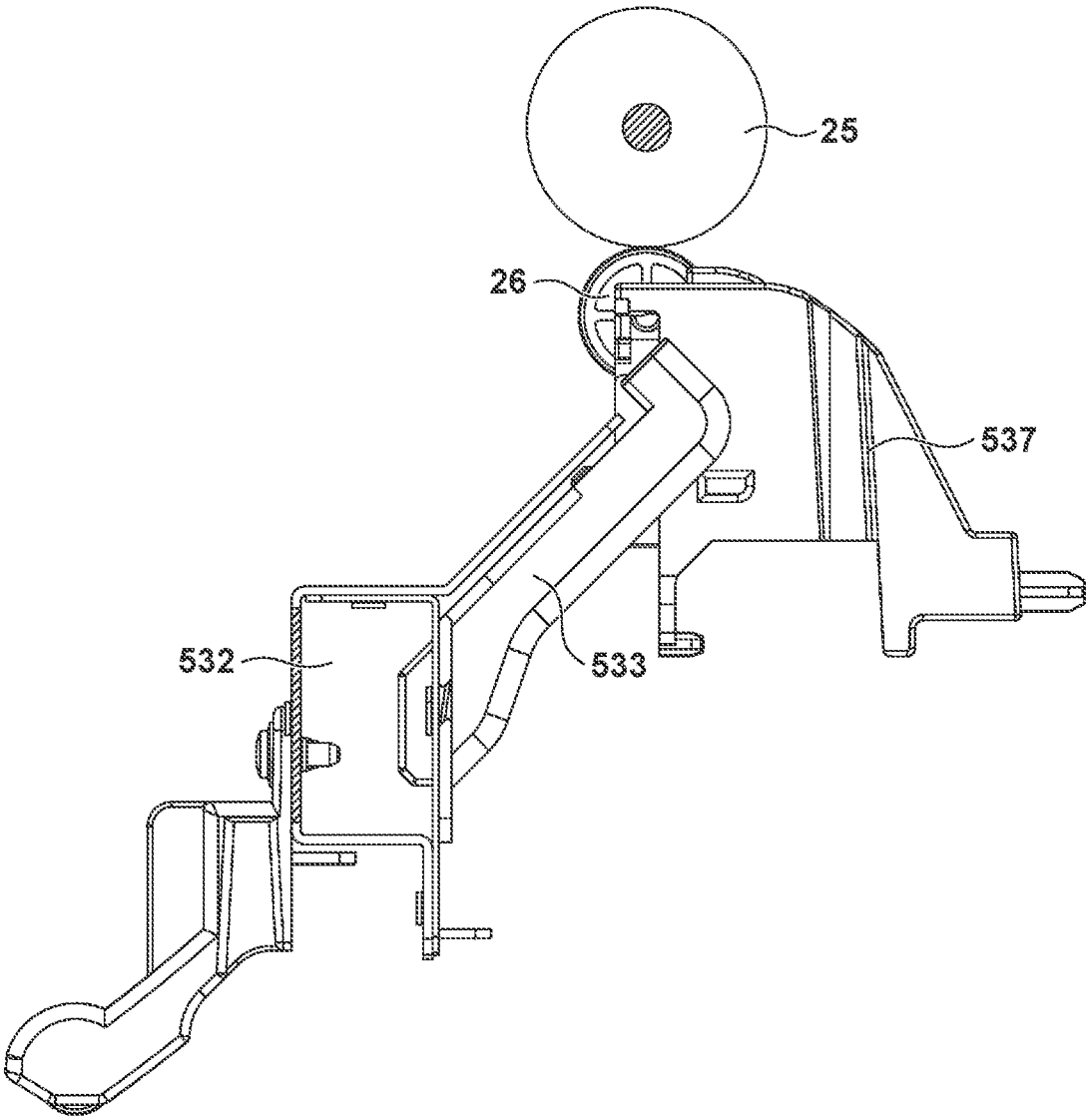
FIG. 10 is a view illustrating a relation between the air blowing port and a sheet eject roller unit.

FIG. 10 is a schematic view illustrating a configuration in the vicinity of an air blowing port 533 and the sheet eject roller 25. The air blowing port 533 is positioned so as not to protrude further than the outer shape of a sheet eject nip roller 26. This makes it possible to prevent an ejected sheet from moving onto the air blowing port 533. Note that in a case where the sheet eject roller 25 and the sheet eject nip roller 26 are switched and the sheet eject roller 25 is positioned on the underside of a sheet surface, the air blowing port 533 is positioned so as not to protrude further than the outer shape of the sheet eject roller 25.

Figure 11A:
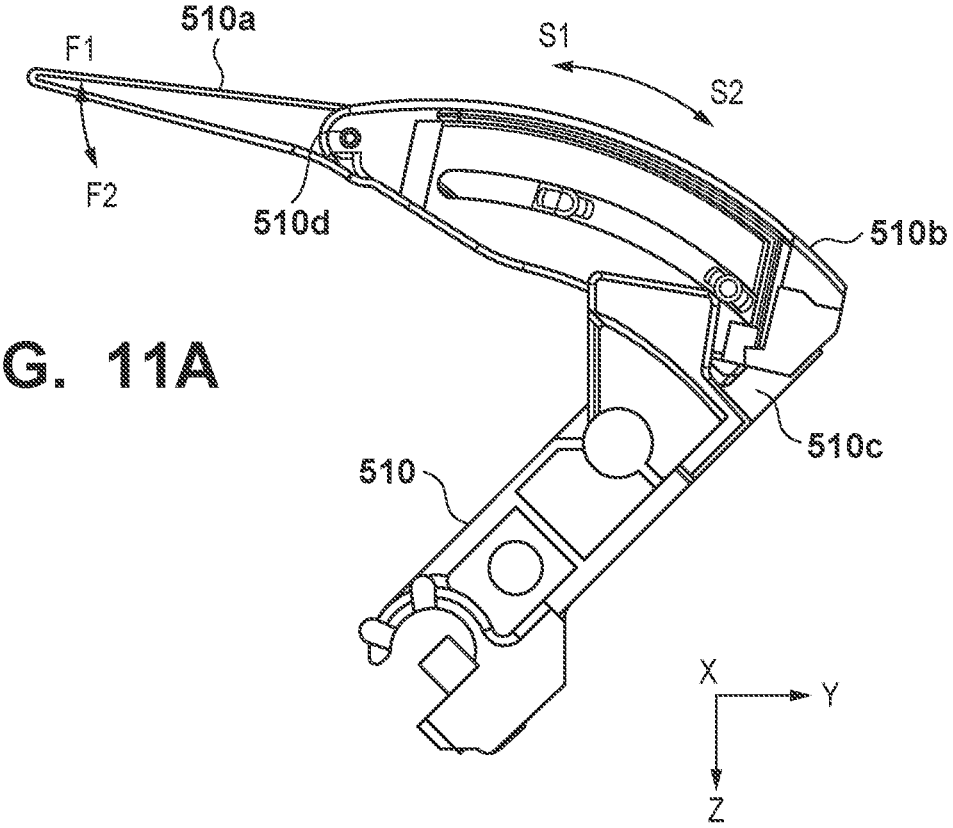
FIGS. 11A and 11B are views describing a movable guide.
Figure 11B:
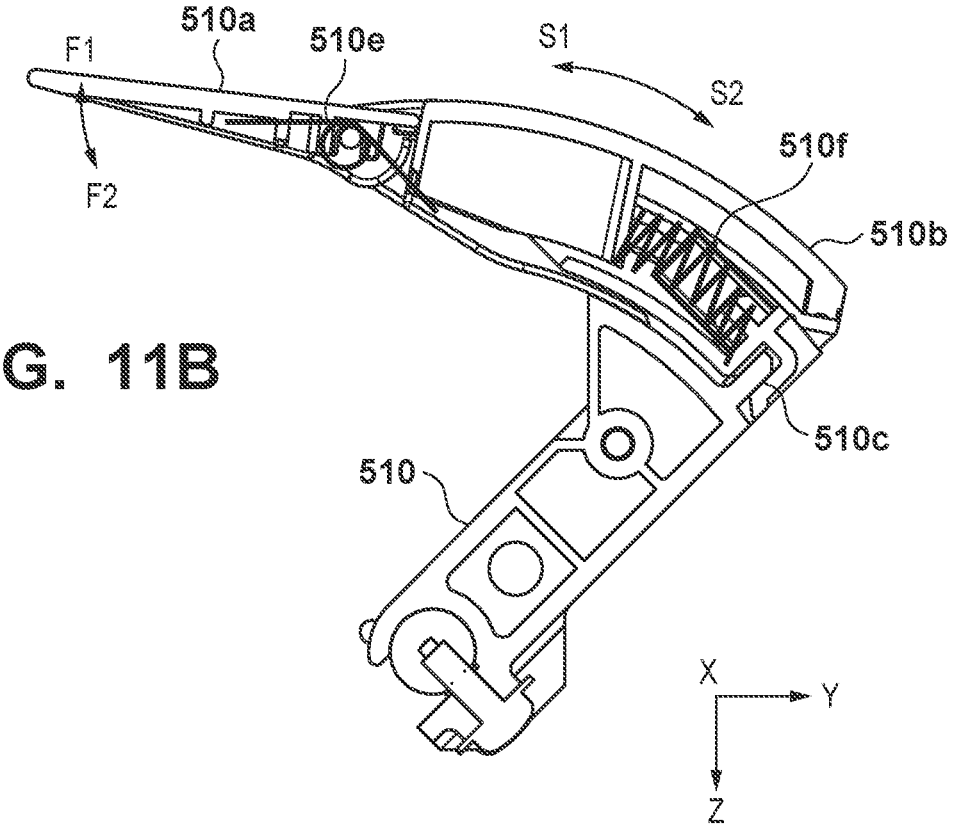

Next, the detailed configuration of a movable guide 510 will be described with reference to FIGS. 11A and 11B. FIGS. 11A and 11B are views illustrating the detailed configuration of a movable guide 510. A flap portion 510*a* positioned at the tip of the movable guide for pressing the stacked sheet 1*a* is coupled to a slide portion 510*b* so as to be able to rotate in directions indicated by arrows F1 and F2 about a rotation center 510*d*. The flap portion 510*a*, as illustrated in FIG. 11B, is biased in the direction indicated by the arrow F1 by a biasing spring 510*e* attached between the flap portion 510*a* and the slide portion 510*b*. The state of FIG. 11B indicates a state in which the flap portion 510*a* has abutted the slide portion 510*b* and stopped; however, if force is applied in a Z-axis direction on the flap portion 510*a*, the flap portion 510*a* can be rotated in a direction indicated by the arrow F2.

The movable guide 510 functions as follows due to the flap portion 510*a* being movable as described above. In other words, the movable guide 510, when pressing the sheet 1 and the stacked sheet 1*a*, functions so as to press the curl from the top side of the curl of the sheet 1 and the stacked sheet 1*a*. Meanwhile, the movable guide 510, when retracting, functions such that the flap portion 510*a* rotates in the direction indicated by the arrow F2 due to the weight of the sheet 1 and the flap portion 510*a* is pulled out from the sheet 1 and the stacked sheet 1*a*.

The slide portion 510*b* can be moved in an arced trajectory in a direction indicated by an arrow S1 and a direction indicated by an arrow S2 with respect to a drive coupling portion 510*c* and is biased in the direction indicated by the arrow S1 by a biasing spring (elastic member) 510*f*. In the state of FIGS. 11A and 11B, the slide portion 510*b* has abutted a stopper arranged in the drive coupling portion 510*c* and stopped. Then, when the movable guide 510 presses the sheet 1 and the stacked sheet 1*a*, the slide portion 510*b*, which is integrated with the flap portion 510*a*, moves in the direction indicated by the arrow S2. Meanwhile, since the slide portion 510*b* is pressed in the direction indicated by the arrow S1 by the biasing spring 510*f*, the sheet 1 and the stacked sheet 1*a* can be gripped between the movable guide 510 and the tray 29. The slide portion 510*b*, when the thickness of the stacked sheet 1*a* increases, increases in the amount of movement in the direction indicated by the arrow S2, and spring force generated by the biasing spring 510*f* also increases. Accordingly, in a case where curl force that the stacked sheet 1*a* has is large, such as in a case where the stacked sheet 1*a* is thick paper, there is a large number of sheets, or the like, it is possible to generate stronger pressing force.

Figure 12A:
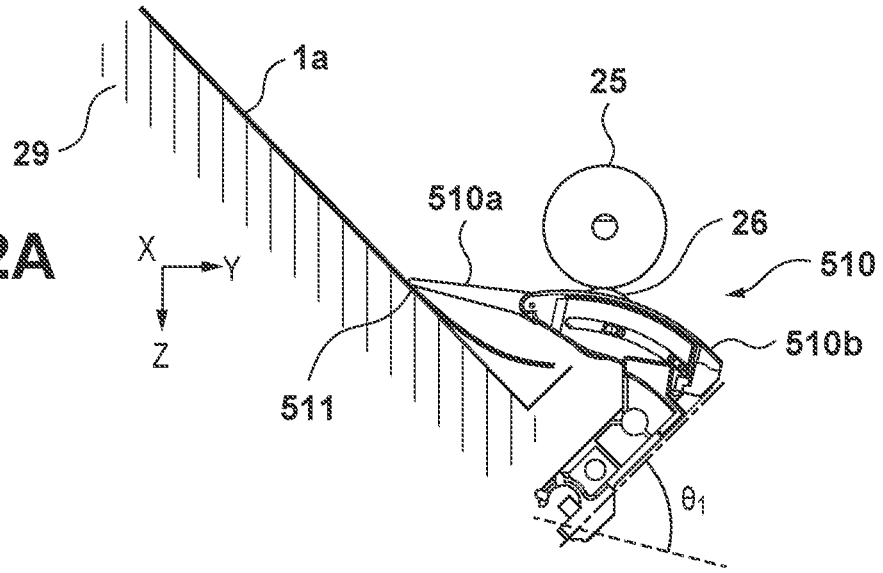
FIGS. 12A to 12C are views describing states in which the movable guide is protruding and a state in which the movable guide is pressing a stacked sheet.
Figure 12B:
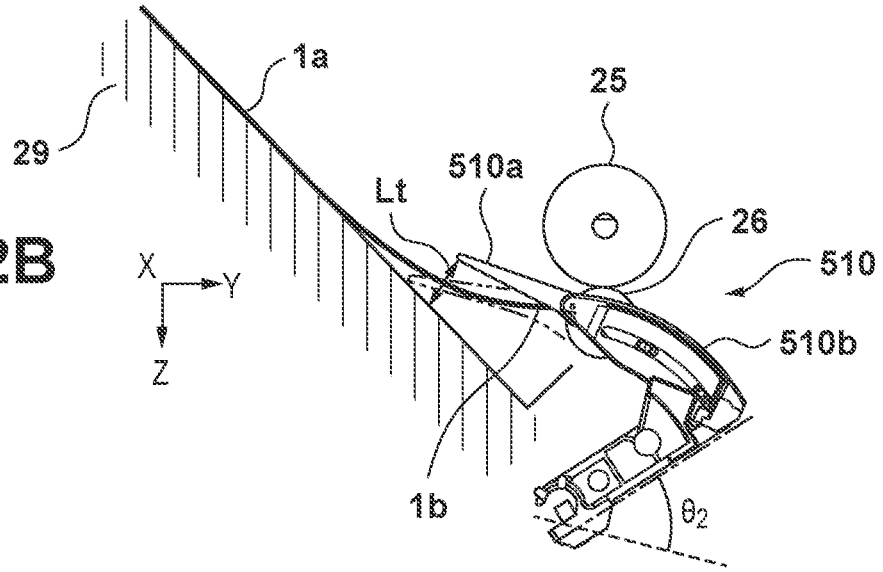
Figure 12C:
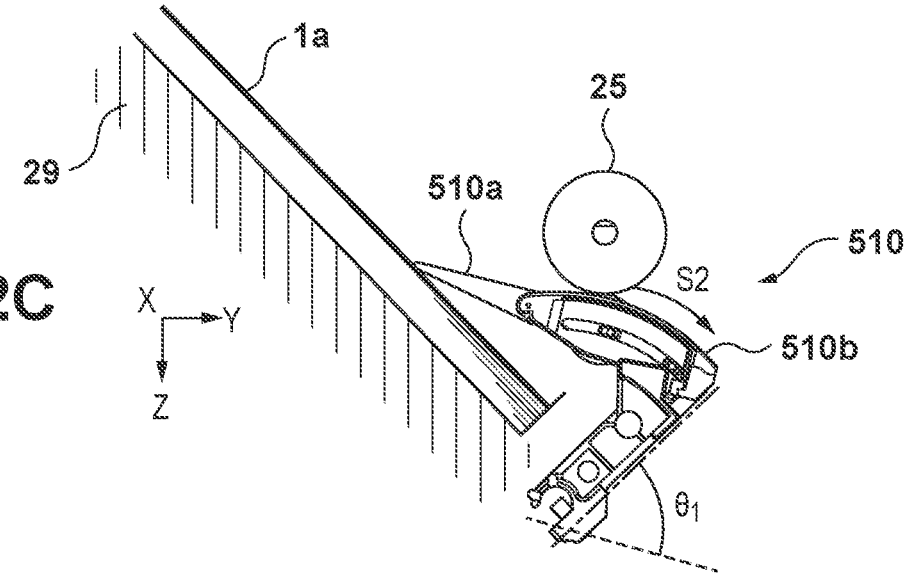
Figure 13:
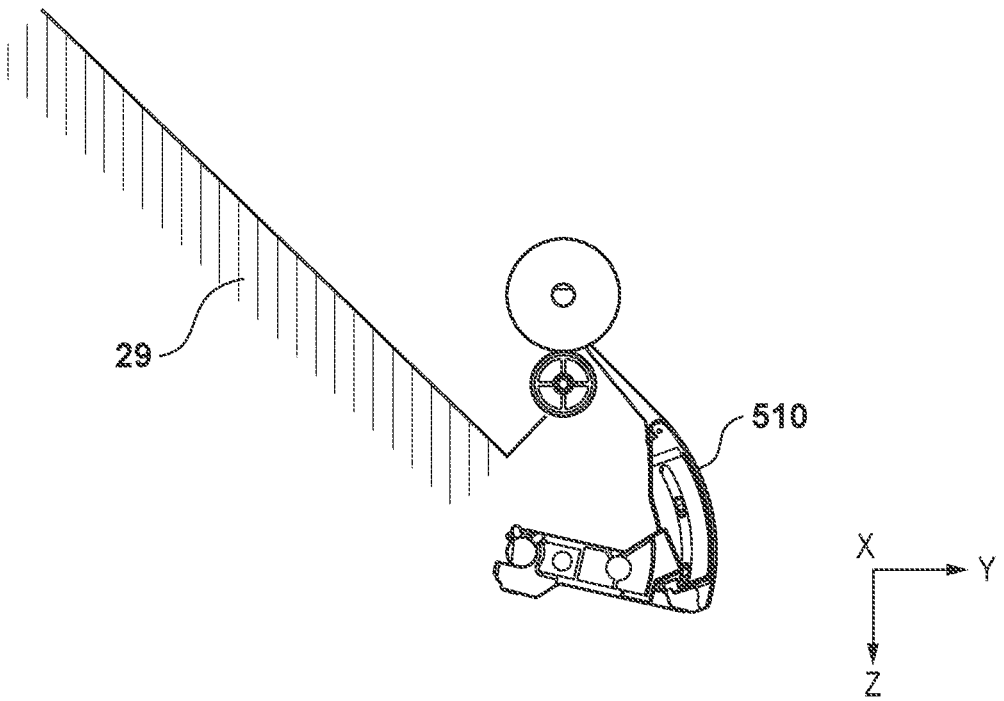
FIG. 13 is a view describing a retracted state of a movable guide.

A first protruding state in which there is one stacked sheet 1*a* on the tray 29 and a movable guide 510 is protruding until it causes the stacked sheet 1*a* to be in close contact with the tray 29 (first protruding position) is illustrated in FIG. 12A. A second protruding state in which there is one stacked sheet 1*a* on the tray 29 and the movable guide 510 is protruding such that there is a gap indicated by Lt between the flap portion 510*a* and the tray 29 (second protruding position) is illustrated in FIG. 12B. A state in which there are approximately 100 stacked sheets 1*a* on the tray 29 and the movable guide 510 is in a protruding state is illustrated in FIG. 12C. Furthermore, a state in which the movable guide 510 is retracted is illustrated in FIG. 13.

In FIGS. 12A to 12C, the edge line of the drive coupling portion 510*c* in a retracted state is indicated by a dashed line and the edge line that is the same as the dashed line of the drive coupling portion 510*c* but in a protruding state (protruding position) is indicated in a dash-dotted line. In FIG. 12A and FIG. 12C, an angle θ1 formed by the dashed line and the dash-dotted line coincide; however, in FIG. 12C, the flap portion 510*a* and the slide portion 510*b* slide in the direction indicated by the arrow S2 in accordance with the number of stacked sheets.

In the first protruding state of FIG. 12A, the stacked sheet 1*a* is pinched between the flap portion 510*a* and the tray 29 at the contact point 511 and is gripped by the movable guide 510. Accordingly, when the sheet 1 passes over the stacked sheet 1*a*, the stacked sheet 1*a* will not be moved by the friction caused between the sheet 1 and the stacked sheet 1*a*. Meanwhile, in the second protruding state of FIG. 12B, the stacked sheet 1*a* is not gripped by the movable guide 510, and a gap indicated by Lt is formed between the flap portion 510*a* and the tray 29.

In the present embodiment, the maximum number of stacked sheets on the tray 29 is set to 100 sheets, and the stacked sheets 1*a* of a thickness of approximately 10 mm is stacked on the tray 29. Accordingly, by setting the dimension of Lt to greater than or equal to 10 mm, it is possible to cause a state in which the stacked sheets 1*a*, regardless of the number of stacked sheets 1*a*, are not gripped by the movable guide 510.

In the second protruding state of FIG. 12B, the movable guide 510 is positioned such that an edge 1*b* of the stacked sheet 1*a* is apart from the point at which the sheet eject roller 25 and the sheet eject nip roller 26 contact and that the dashed line of the edge line of the flap portion 510*a* on the lower side in the Z-axis direction is positioned to the left in the Y-axis direction than the point at which the sheet eject roller 25 and the sheet eject nip roller 26 contact. The edge 1*b* of the sheet 1 immediately after sheet ejection is positioned at the point at which the sheet eject roller 25 and the sheet eject nip roller 26 contact; accordingly, when the movable guide 510 is moved to the second protruding state, the edge 1*b* of the stacked sheet 1*a* contacts the flap portion 510*a* and is pushed out as in FIG. 12B. By this, the edge 1*b* of the stacked sheet 1*a* is separated from the point at which the sheet eject roller 25 and the sheet eject nip roller 26 contact.

The switching of the position of the movable guide 510 illustrated in FIG. 12A and FIG. 12B is performed by changing the rotational phase of the drive coupling portion 510*c* as understood from seeing the angle θ1 and an angle θ2 formed by the dashed line and the edge line of the drive coupling portion 510*c*. In FIG. 12A and FIG. 12B, the rotational phase angles are in a relation in which θ1>θ2. The positioning of the rotational phase of the movable guide 510 is performed as follows. In other words, first, it is detected by a position detection sensor 515 for detecting the positions of the movable guides 510 (refer to FIG. 5) that the drive coupling portion 510*c* is in a retracted position of FIG. 13. Then, using that as the origin and by rotating by a predetermined angle (θ1 or θ2), the movable guide 510 is positioned. The predetermined angle, if the driving unit of the movable guide 510 is a pulse motor, need only be managed by the number of driving pulses or the like. Also, if the driving unit is a DC motor or the like, the predetermined angle need only be managed by attaching an encoder. Also, a detection unit for detecting that the drive coupling portion 510*c* is at the angle θ1 or the angle θ2 may be arranged.

Figure 14:
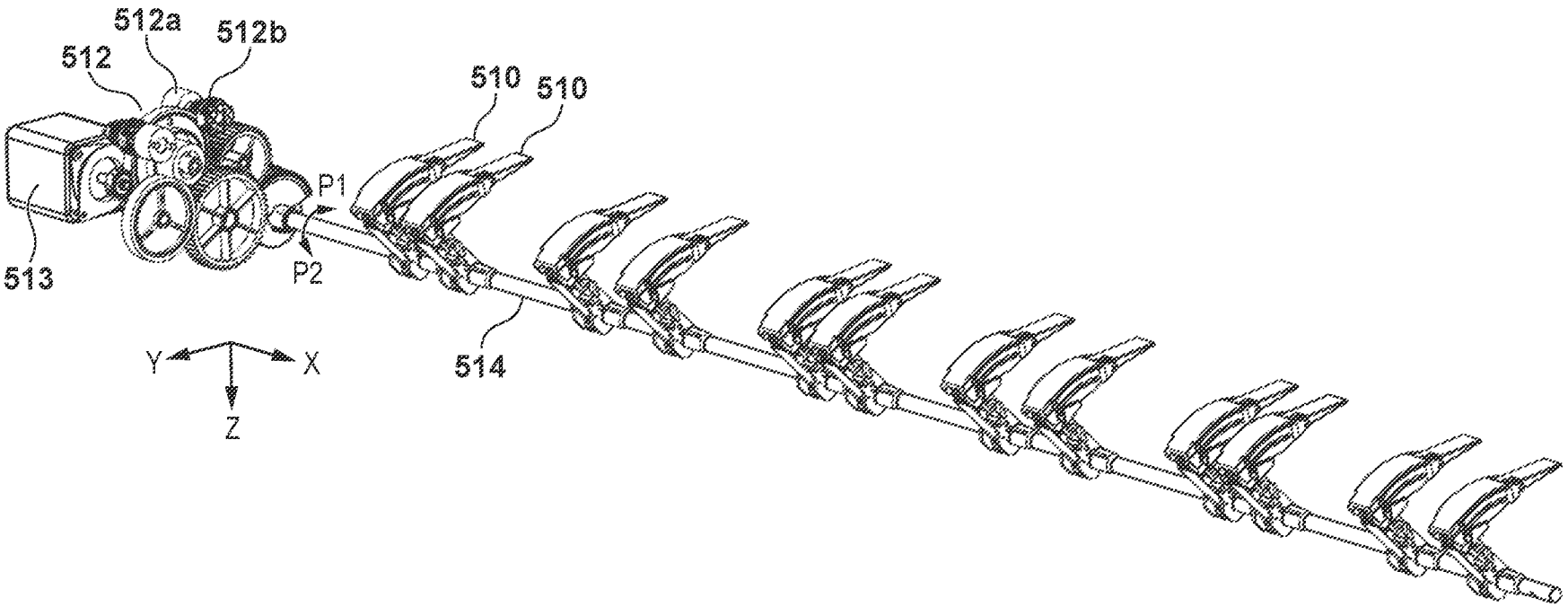
FIG. 14 is a view describing a movable guide driving unit.

FIG. 14 is a view illustrating a configuration of a driving unit of the movable guides 510. The movable guides 510, which have been provided in a plurality in the X-axis direction, are attached in a uniform direction onto a movable guide shaft 514. A gear that is attached to the movable guide shaft 514 is connected with the movable guide driving motor 513 via a driving unit 512 consisting of a series of gears. By driving the movable guide driving motor 513 and rotating the movable guide shaft 514 in a direction indicated by an arrow P1, the movable guides 510 concurrently protrude, and by rotating the movable guide shaft 514 in a direction indicated by an arrow P2, the movable guides 510 concurrently retract. The movable guides 510 are concurrently rotated by the amount of driving of the movable guide shaft; however, since the movable guides 510 comprise biasing springs 510*f*, displacement of the tips of the movable guides 510 is allowed in accordance with the thickness of the stacked sheet 1*a*. When the sheet 1 and the stacked sheet 1*a* are pressed by protrusion of the movable guides 510, the drive coupling portions 510*c* receive the reaction force of the biasing springs 510*f* Accordingly, the movable guide shaft 514 coupled with the drive coupling portions 510*c* receives a pressing torque Tn that rotates in the direction indicated by the arrow P2. If the pressing torque Tn exceeds a holding torque that the driving unit 512 and the movable guide driving motor 513 generate, the movable guide shaft 514 will rotate in the direction indicated by the arrow P2. Accordingly, the force of the biasing springs 510*f* for pressing the sheet weakens, and as a result, the force for pressing the sheet 1 and the stacked sheet 1*a* becomes insufficient.

Thus, in the present embodiment, a torque limiter 512*a* and a one-way clutch 512*b* are arranged in the driving unit 512. The torque limiter 512*a* will slip if a torque that is greater than or equal to a predetermined torque is applied; however, that slip torque value Tl is set to less than or equal to a maximum torque value Tmax at the time of driving of the movable guide driving motor 513. Also, the one-way clutch 512*b* arranged to be coupled with the torque limiter 512*a*, when rotating the movable guide shaft 514 in the direction indicated by the arrow P1, disconnects the drive coupling between the torque limiter 512*a*, the movable guide driving motor 513, and the movable guide shaft 514. Also, the one-way clutch 512*b*, when rotating the movable guide shaft 514 in the direction of the arrow P2, maintains the drive coupling between the torque limiter 512*a*, the movable guide driving motor 513, and the movable guide shaft 514. This makes it so that the load of the slip torque value Tl of the torque limiter 512*a* is not applied to the movable guide driving motor 513 when pressing the stacked sheet 1*a* by the protrusion of the movable guides 510, whereby it is possible to set the driving torque to a value that is less than the maximum torque value Tmax by the slip torque value Tl.

Here, a mechanical load torque value Tm for when the movable guide shaft 514 rotates is defined as a driving load torque necessary for purely driving the driving unit 512 excluding the slip torque value Tl of the torque limiter 512*a* and without the movable guides 510 pressing the sheet 1. Also, the holding torque value that the movable guide driving motor 513 has is defined as Td.

When all the torque values are converted as the torque value on the movable guide shaft 514, relational expressions such as the following are established.

$$P1 \text{ rotational direction: } T\max > Tn + Tm \quad (1)$$

$$\text{Suspended in protruding state: } Tl + Tm + Td > Tn \quad (2)$$

$$P2 \text{ rotational direction: } T\max > Tl + Tm \quad (3)$$

From Expressions (1) and (3), it is understood that it is possible to set the pressing torque Tn and the slip torque Tl to be approximately the same. Also, it is understood that the mechanical load torque Tm and the holding torque Td of the motor necessary for when the movable guides 510 are suspended in a protruding state need only be set to a value lower than the pressing torque Tn.

Meanwhile, in a case where the torque limiter 512*a* is not provided, the slip torque Tl will be eliminated from Expression (2); accordingly, the mechanical load torque Tm and the holding torque Td of the motor need to be set so as to exceed the pressing torque Tn. In other words, if the pressing torque Tn increases, the mechanical load torque Tm and the holding torque Td of the motor need to be increased. If the mechanical load torque Tm is increased, the necessary maximum torque Tmax of the movable guide driving motor 513 will also increase based on Expressions (1) and (3). If the holding torque Td of the motor is increased, configuration in which power consumption of the motor increases (e.g., the movable guide driving motor 513 is excited also during suspension) will be necessary. In contrast to this, in the present embodiment, such a configuration is unnecessary, and it is possible to select the movable guide driving motor 513 provided with the smallest maximum torque value Tmax required.

Figure 15:
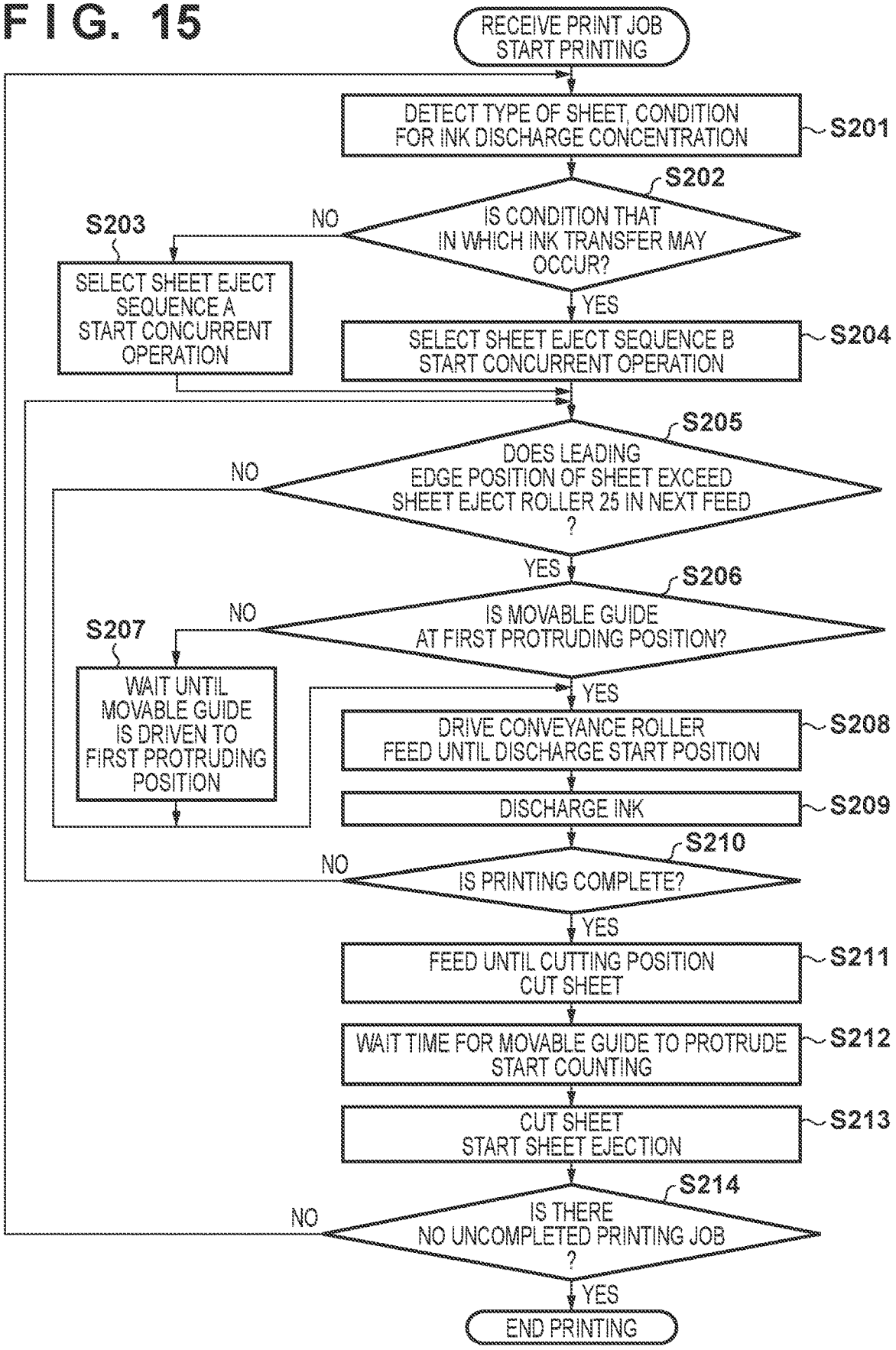
FIG. 15 is a flowchart illustrating a sheet eject operation.

Next, a sequence of an upper face sheet eject operation will be described. FIG. 15 is a flowchart that relates to an operation of the sheet eject unit in a print sequence of the printing apparatus 100.

At the time of reception of a print JOB, the sheet type and ink discharge concentration used for printing are detected (step S201) and it is determined whether or not a condition is that in which transfer of ink onto another sheet 1, the tray 29, and the like to be contacted would occur (step S202). For example, in accordance with ink fixability and ink discharging mode with reference to a table illustrated in FIG. 16, it is determined whether or not the condition is that in which ink transfer would occur.

Then, based on the determination result in step S202, a sheet eject sequence A (step S203) or a sheet eject sequence B (step S204) is selected. Detailed operations of the sheet eject sequence A and the sheet eject sequence B will be described later. In a case where the sheet eject sequence B is selected, a waiting period Tc of the movable guides 510 to be described later is also decided. A sheet eject operation is concurrently performed with the print operation based on the selected sheet eject sequence.

When the sheet eject operation is completed, preparation for ejecting the next sheet is performed. Since the ejection of the next sheet is started in a state in which the movable guides 510 are pressing the trailing edge of the sheet 1 stacked on the tray 29, it is determined whether or not the leading edge position of the next sheet exceeds the sheet eject roller 25 based on the length of conveyance of the next sheet (step S205).

It is detected whether the movable guides 510 are in the first protruding state (step S206) and in a case where the movable guides 510 are not in the first protruding state, the conveyance of the sheet is suspended until the movable guides 510 transition to the first protruding state (step S207).

After the movable guides 510 press the trailing edge of the sheet 1 in the first protruding state, the next sheet is conveyed to the next position, which is an ink discharge position, (step S208) and ink discharge is performed by the printhead 18 (step S209).

Print completion determination is performed (step S210) and if printing has not been completed, steps S205 to S210 will be repeated.

After printing has been completed in step S210, the sheet is conveyed to the cutting position and a sheet cut is performed (step S211). After the sheet has been cut, in a case where the waiting period Tc is necessary at the time of protrusion of the movable guides 510 in the sheet eject sequence decided in step S202, counting of the waiting period Tc is performed (step S212) before the post-sheet-cut conveyance is resumed, and then sheet conveyance is resumed (step S213).

After sheet ejection has been completed, it is confirmed whether or not there remains an uncompleted print JOB (step S214). In a case where there remains an uncompleted print JOB, the processing returns to step S201 and in a case where there remains no uncompleted print JOB, printing is ended.

Figure 17:
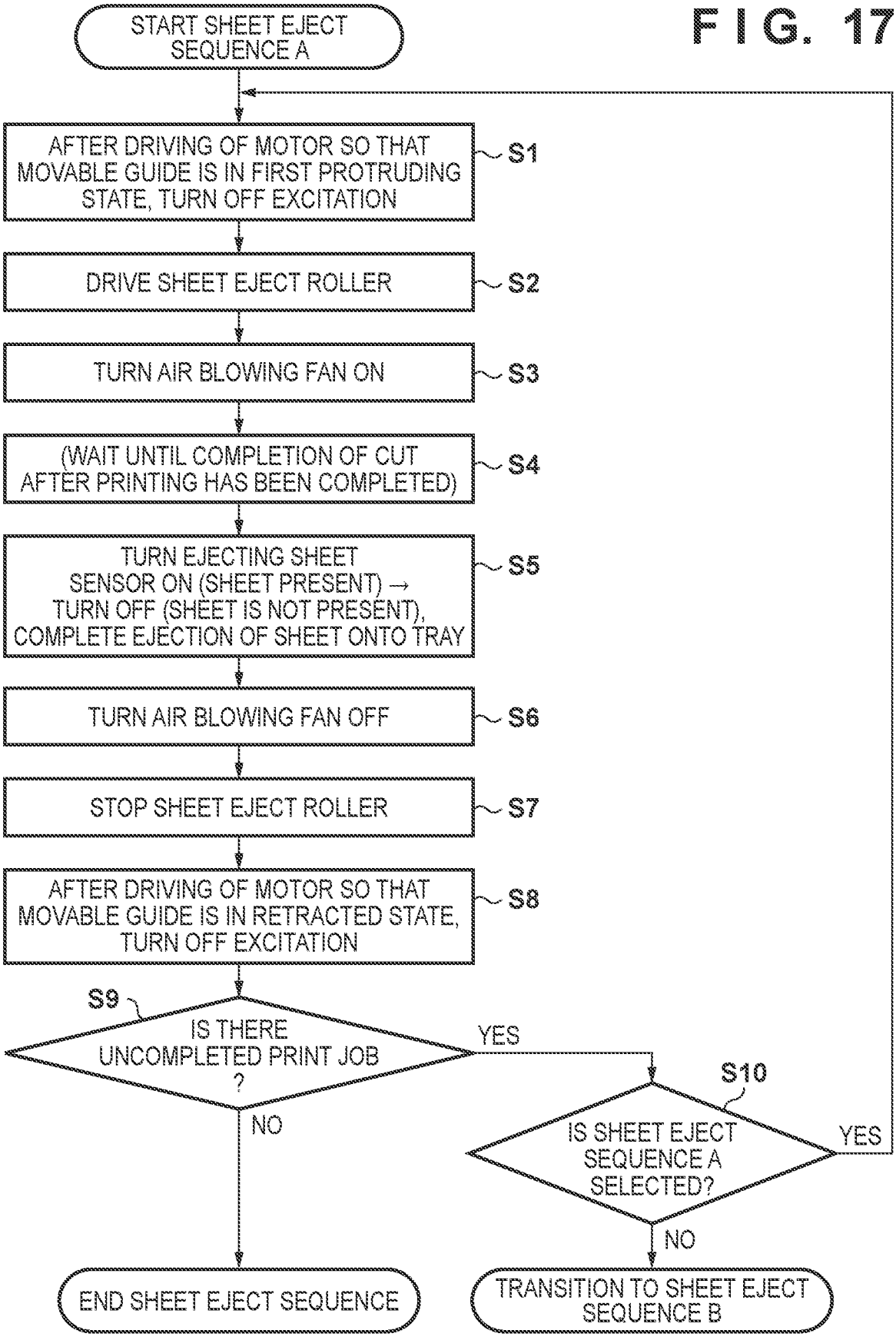
FIG. 17 is a flowchart illustrating an operation of a sheet eject sequence A.
Figure 18:
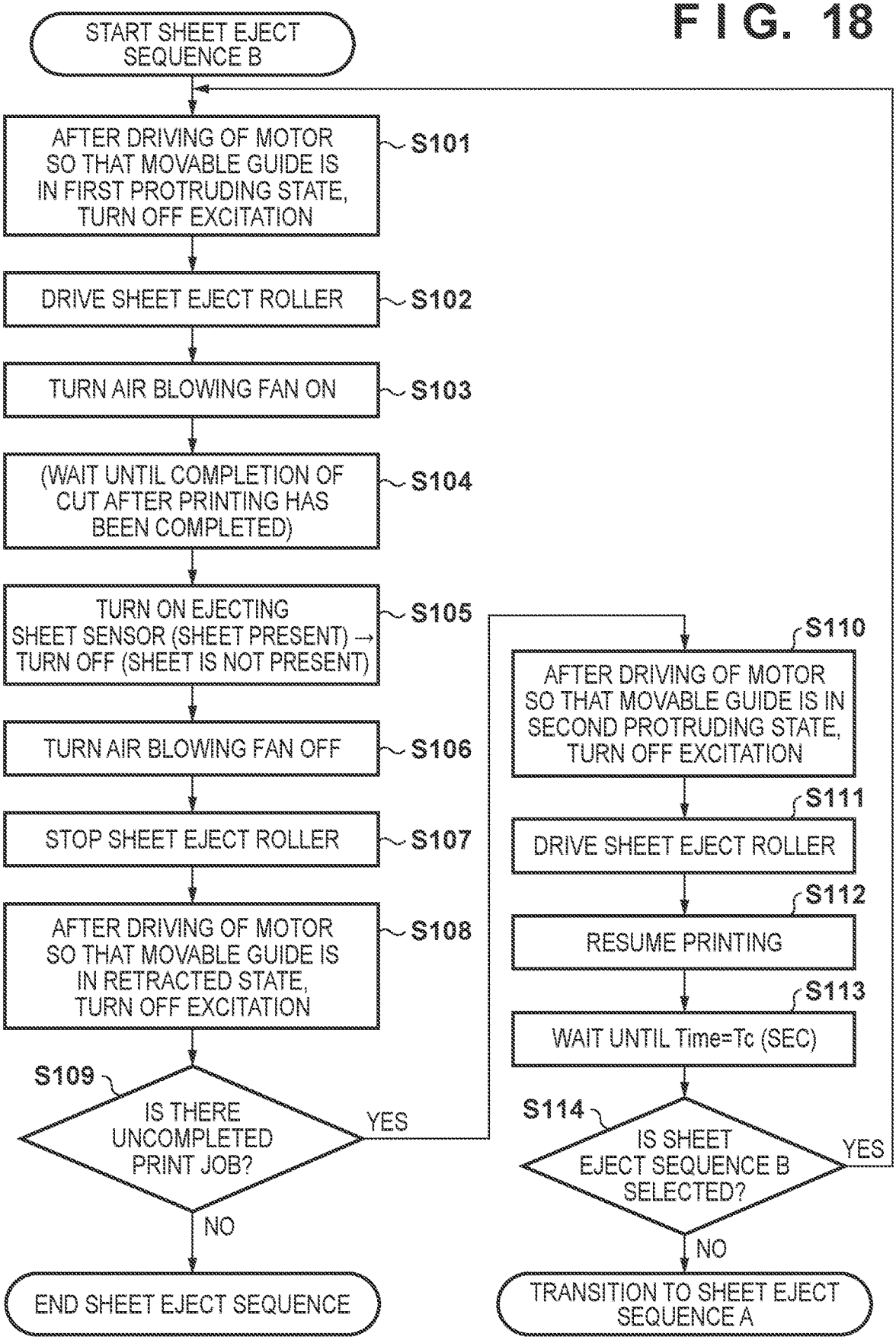
FIG. 18 is a flowchart illustrating an operation of a sheet eject sequence B.

Next, the sheet eject sequence A selected in step S203 will be described with reference to FIG. 17. Also, the sheet eject sequence B selected in step S204 will be described with reference to FIG. 18.

Figure 19:
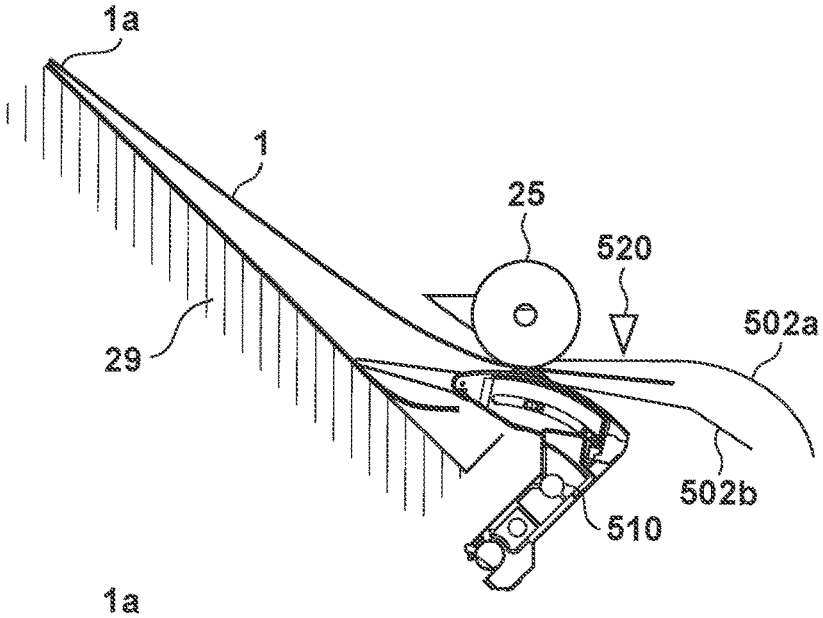
FIG. 19 is a view illustrating a state at the time of the start of sheet ejection.

The sheet eject sequence A will be described. At the time of start of the sheet eject operation, a movable guide 510, as in FIG. 19, is moved to a position at which the tip of the movable guide 510 contacts the tray 29 or a first pressing position, which is the first protruding state at which the tip of the movable guide 510 presses the trailing edge of a stacked sheet 1*a*. At this time, by turning OFF excitation after the driving of the movable guide driving motor 513, it is possible to reduce power consumption (step S1).

After the movable guide 510 enters the first protruding state, driving of the sheet eject roller 25 is started (step S2) and a sheet eject operation is performed. At the time of the sheet eject operation, the air blowing fan 531 for supplying air for drying the printing surface toward the printing surface from the vicinity of the sheet eject roller 25 is turned ON (step S3). In this state, completion of a cut after printing has been completed is awaited (step S4).

Figure 20:
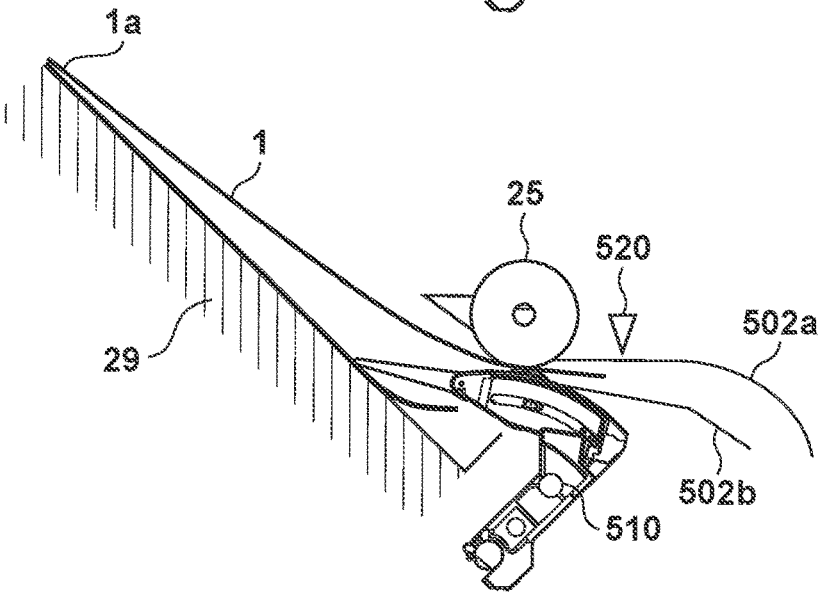
FIG. 20 is a view illustrating a state in which the trailing edge of a sheet has been detected.
Figure 21:
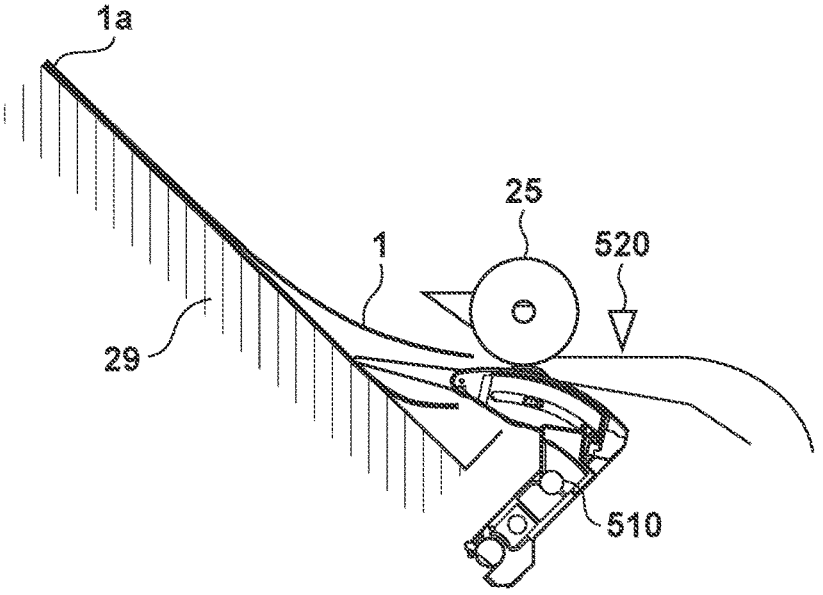
FIG. 21 is a view illustrating a state in which the sheet has been ejected onto a tray.

After detection of the trailing edge of the sheet 1 by an ejecting sheet sensor 520 on the upstream side of the sheet eject roller 25 (step S5) as in FIG. 20, an elapse of a predetermined amount of time in which the sheet 1 is ejected onto the tray 29 is awaited as in FIG. 21. Then, the air blowing fan 531 is turned OFF, and the supply of air is stopped (step S6). If the air blowing fan 531 is not turned OFF after the ejection, excess air enters under the sheet 1 that has been ejected above the movable guide 510 at the time the movable guide 510 retracts and an adverse effect, such as a missing sheet when the sheets are to be pressed again by the movable guide 510 is conceivable.

Figure 22:
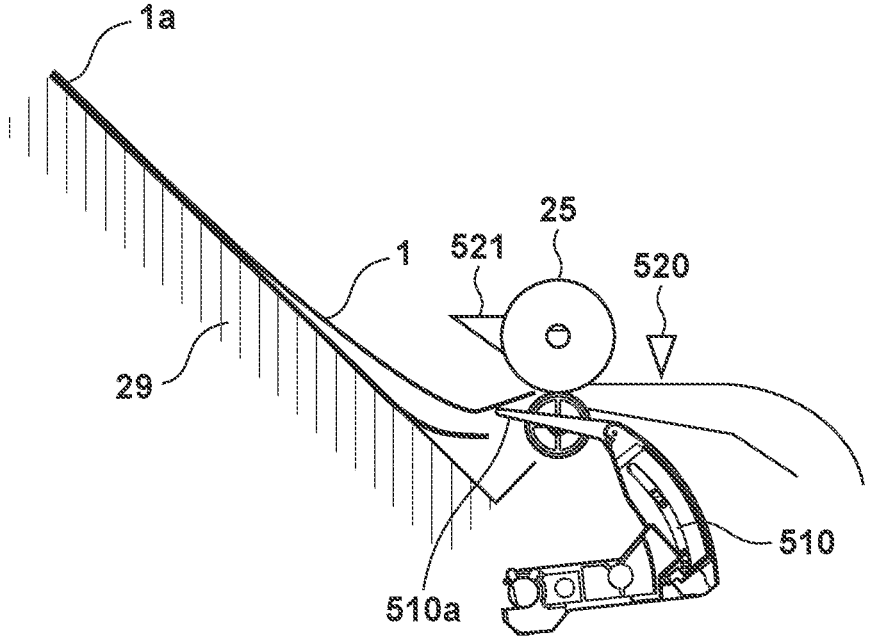
FIG. 22 is a view illustrating a state in which the movable guide has started retracting.
Figure 23:
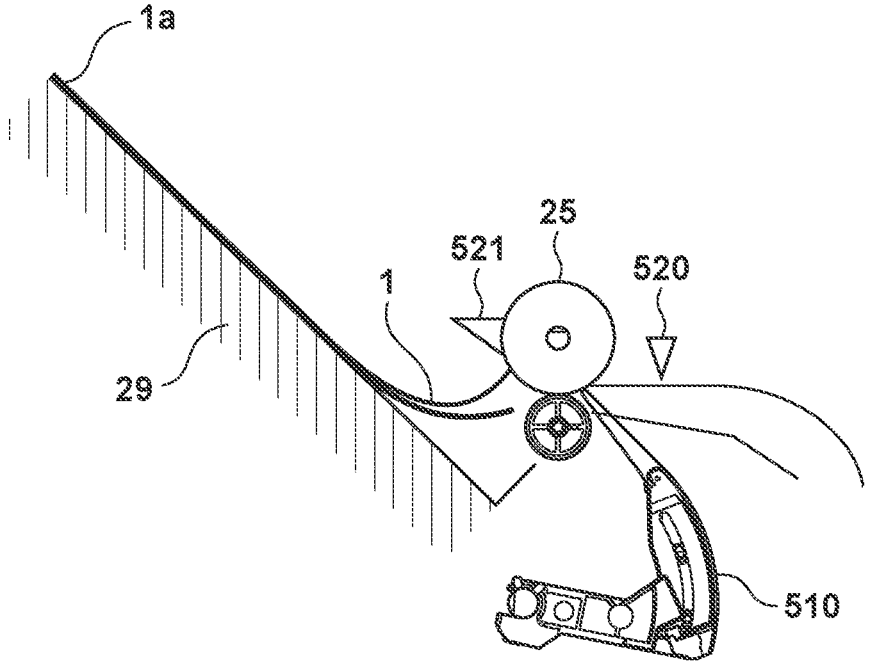
FIG. 23 is a view illustrating a state in which the movable guide has moved to a retracted position.

After the sheet 1 has been ejected onto the tray 29, the driving of the sheet eject roller 25 is stopped (step S7) and the movable guide 510 is retracted. At this time, the movable guide 510 that has burrowed under the sheet 1 that has been ejected onto the tray 29 as in FIG. 22 is rotated toward the sheet eject roller 25 side and is retracted to the retracted position at which it is completely detached from the sheet 1 as in FIG. 23. By the flap portion 510*a* of the movable guide 510 rotating so as to escape due to the weight of the sheet 1 as in FIG. 22, it is possible to pull out the movable guide 510 without damaging the sheet 1 by sandwiching it between the flap portion 510*a* and a downstream guide 521. In the state of FIG. 23, the state is such that the curl of the edge of the sheet 1 is not pressed at all by the movable guide 510; however, the position of the edge of the sheet 1 is regulated by the downstream guide 521.

After the movable guide 510 has been moved to the retracted position, the excitation of the movable guide driving motor 513, which operates the movable guide 510, is turned off (step S8). The sequence from steps S6 to S8 is a sequence for preventing the sheet 1, even if the trailing edge of the sheet 1 is curled, from being pushed out in the conveyance direction or becoming damaged due to the trailing edge of the sheet 1 contacting the sheet eject roller 25 at the time of retraction of the movable guide 510.

In the retracted state of the movable guide 510, it is confirmed whether there remains an uncompleted print JOB (step S9). In a case where there remains an uncompleted print JOB, it is confirmed whether to select the sheet eject sequence A or the sheet eject sequence B in the next printing (step S10). In a case where the sheet eject sequence A is selected, the processing returns to step S1 again and in a case where the sheet eject sequence B is selected, the processing transitions to step S101 of the sheet eject sequence B.

Figure 24:
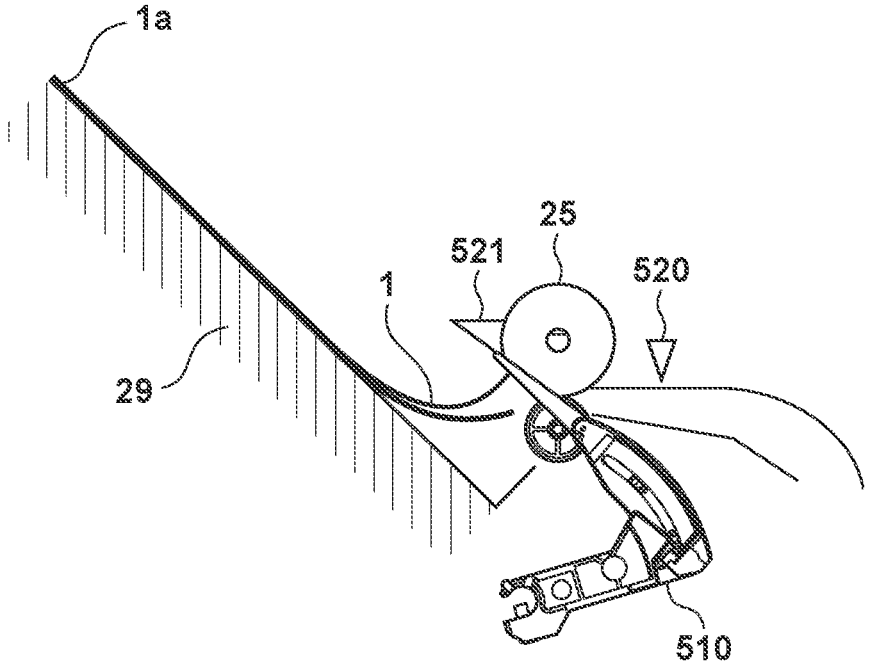
FIG. 24 is a view illustrating a state in which the movable guide has started pressing the sheet immediately after sheet ejection.
Figure 25:
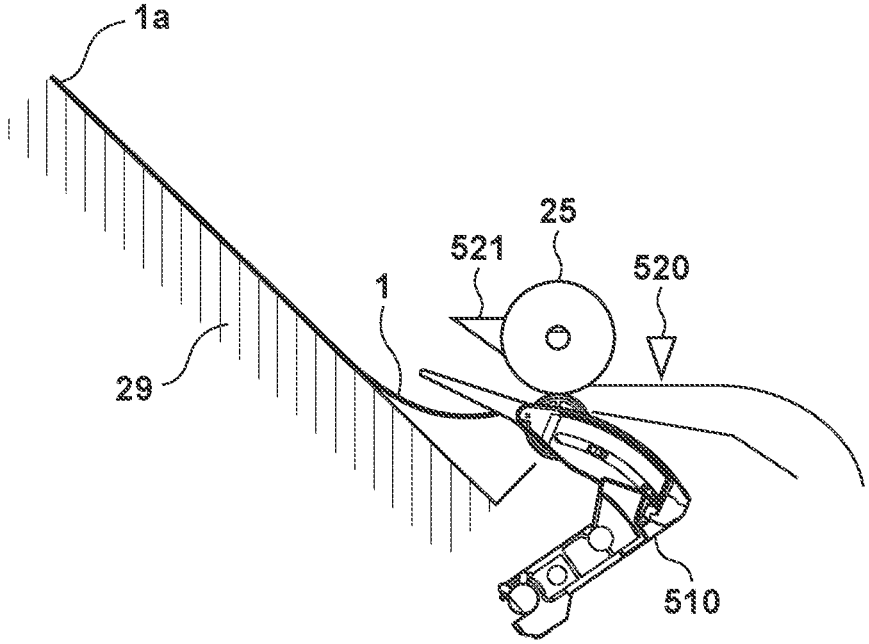
FIG. 25 is a view illustrating a state in which the movable guide has moved to a second pressing position.
Figure 26:
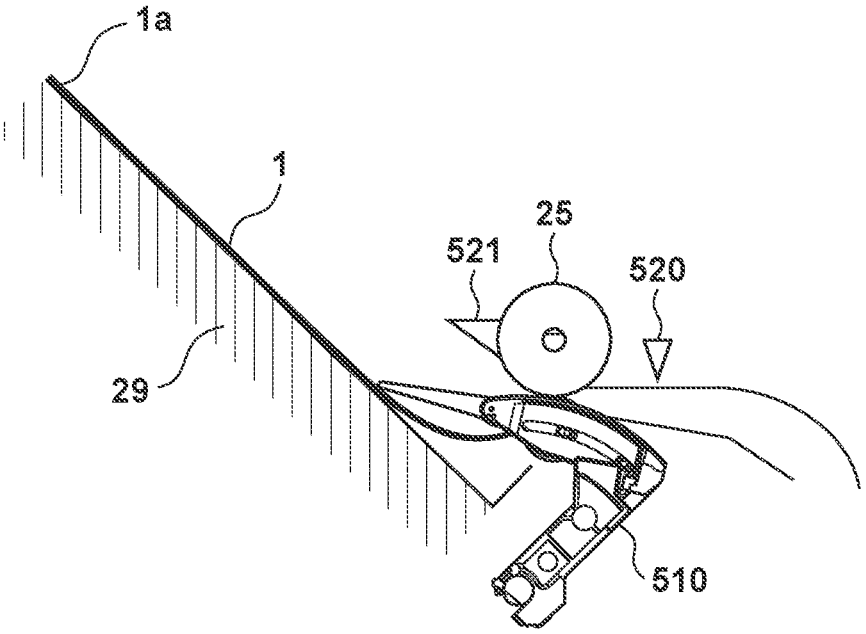
FIG. 26 is a view illustrating a state in which the movable guide has moved to a first pressing position.

When moving the movable guide 510 from the retracted position to the first pressing position, the curled trailing edge of the sheet 1 is pushed by the movable guide 510 as in FIG. 24 and after the state of FIG. 25, the sheet 1 is ultimately pressed by the tip of the movable guide 510 as in FIG. 26.

Figure 27:
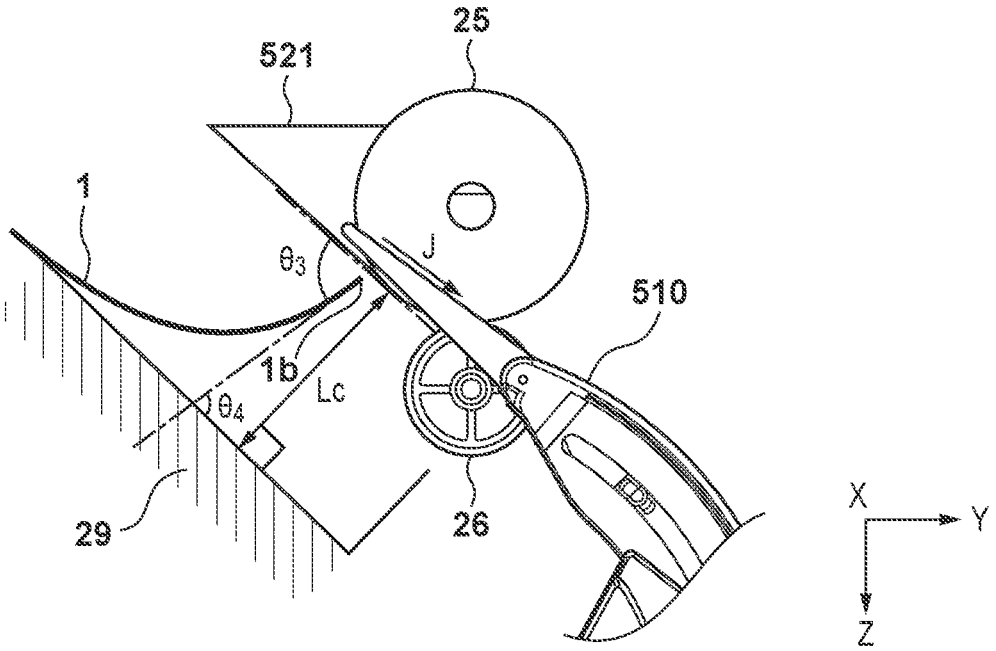
FIG. 27 is a view illustrating a state in which the movable guide has started pressing the sheet immediately after sheet ejection.

FIG. 27 is a view illustrating a magnification of a peripheral portion of the sheet eject roller 25 of FIG. 24. A trailing edge 1*b* of the curled sheet 1 near the downstream guide 521 and the flap portion 510*a* rotated by passing beside the sheet eject roller 25 contact. An angle θ3 that the flap portion 510*a* and a dash-dotted line, which is a tangent of the trailing edge 1*b* of the curled sheet 1, form is slightly smaller than 90° and contact is made at an acute angle; accordingly, the trailing edge 1*b* escapes in a direction indicated by an arrow J without the curl being squashed from the top. Accordingly, the sheet 1 moves from as in FIG. 25 to as in FIG. 26. At this time, by setting a gap Lc between the tray 29 and the downstream guide 521 to be smaller than a curl radius R that the sheet 1 may take, an angle θ4 that the tangent of the trailing edge 1*b* and the tray 29 form becomes smaller than approximately 90°.

In the present embodiment, in the phase of FIG. 27 in the trajectory of a rotation of the flap portion 510*a*, the tray 29 and the pressing surface of the flap portion 510*a* are approximately parallel; accordingly, it is possible to maintain the angle θ3 to be smaller than approximately 90°.

In a case where there remains no uncompleted printing JOB in step S9, the sheet eject sequence A ends. In the sheet eject sequence A, the movable guide 510 is moved to the first protruding state again immediately after the movable guide 510 has entered the retracted state; accordingly, the period of time in which the sheet 1 and the stacked sheet 1*a* are not gripped by the movable guide 510 is short. Accordingly, there is an advantage that there is less opportunity for the stacked sheet 1*a* to be moved by external disturbance (vibration of the printing apparatus 100, shaking due to the user removing the stacked sheet 1*a*, force of airflow of an air conditioner or the like), whereby the series of operations is completed in a short amount of time.

Next, the sheet eject sequence B will be described. Steps S101 and S108, which are from the start of a sheet eject sequence until the movable guide is moved to the retracted state, is the same as steps S1 to S8 of the sheet eject sequence A.

In the retracted state of the movable guide 510, it is confirmed whether there remains an uncompleted print JOB (step S109).

In a case where there remains an uncompleted print JOB, the movable guide 510 is rotated to the second pressing position, which is the second protruding state, as in FIG. 25 and excitation of the movable guide driving motor 513 is turned off (step S110).

In order to eject the next sheet, the sheet eject roller 25 is driven while the movable guide 510 is in the second pressing position (step S111), and then printing is resumed (step S112).

The movable guide 510 is made to wait in the second pressing position in order to prevent ink transfer (step S113) and is returned to the first pressing position after the waiting period Tc has elapsed (after it stops for a predetermined period of time). Note that the condition of drying of the ink depends on the type of paper; accordingly, the waiting period Tc is set in accordance with the type of paper.

It is confirmed whether the next printing selects the sheet eject sequence A or the sheet eject sequence B (step S114), in a case where the sheet eject sequence A is selected, the processing returns to step S1 of the sheet eject sequence A, and in a case where the sheet eject sequence B is selected, the processing returns to step S101.

In a case where there remains no uncompleted printing JOB in step S109, the sheet eject sequence B ends.

In the sheet eject sequence B, by setting aside time in which the sheet 1 and the stacked sheet 1*a* are not gripped by the movable guide 510, it is possible to dry the sheet 1 ejected immediately after printing. This makes it possible to prevent ink transfer between the sheets or onto the stacking tray. Meanwhile, the sheet 1 and the stacked sheet 1*a* are not gripped by the movable guide 510 until ink drying progresses; accordingly, there is more opportunity for the sheet to be moved by external disturbance than in the sheet eject sequence A. Also, the next sheet 1 cannot be ejected onto the tray 29 until ink drying is completed and the movable guide 510 enters a first pressing state; accordingly, the amount of time of a series of operations becomes longer.

As described above, by virtue of the present embodiment, in the sheet eject sequence A, it is possible to perform stacking of printed sheets in a stable manner and at high speed for sheets with good ink fixability. Also, in the sheet eject sequence B, stopping the movable guide at the second pressing position makes it possible, even in the sheets with poor ink fixability, to prevent ink transfer between the sheet or onto the stacking tray and to perform a stable stacking of sheets without causing damage to the sheets.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-166112, filed Sep. 30, 2020, which is hereby incorporated by reference herein in its entirety.

What is claimed is:

1. A printing apparatus comprising:

a sheet eject tray on which sheets ejected in a first direction by an eject roller are to be stacked; and a movable guide configured to be able to move to a first posture in which the movable guide contacts with the sheet and forces the sheet onto the sheet eject tray, an away posture in which the movable guide is away from the sheet, and a second posture which is between the first posture and the away posture, in the second posture, a downstream end of the movable guide with respect to the first direction being positioned at a downstream side of an upstream end of the sheet ejected to the eject tray in the first direction, wherein the movable guide performs a first moving operation in which the movable guide takes the first posture when a downstream end of the sheet with respect to the first direction is conveyed by the eject roller, the movable guide moves to the away posture after the upstream end of the sheet with respect to the first direction is conveyed by the eject roller, and thereafter the movable guide moves from the away posture to the second posture and stops.

2. The printing apparatus according to claim 1, wherein a plurality of movable guides are arranged in a width direction of a sheet.

3. The printing apparatus according to claim 2, further comprising an air blowing device configured to supply air between a sheet to be ejected onto the sheet eject tray and the sheet eject tray.

4. The printing apparatus according to claim 3, wherein the air blowing device blows air in a third direction, which is a direction that connects a point connecting an extension of the sheet to be ejected and an extension of the sheet eject tray, and an air blowing port of the air blowing device, and the third direction is a direction between the first direction in which the sheet is to be ejected and a second direction in which the sheet is to be stacked onto the sheet eject tray.

5. The printing apparatus according to claim 4, wherein an extended line of the first direction and an extended line of the second direction intersect.

6. The printing apparatus according to claim 3, wherein the air blowing device includes a plurality of air blowing ports that are respectively arranged between the plurality of movable guides.

7. The printing apparatus according to claim 6, wherein the air blowing device includes one fan that is shared by and blows air to the plurality of air blowing ports.

8. The printing apparatus according to claim 3, wherein the air blowing device is arranged in a vicinity of an eject roller that ejects a sheet and on an underside of a sheet to be ejected.

9. The printing apparatus according to claim 8, wherein the eject roller contacts a driven roller that is facing the eject roller across a sheet, and the air blowing device is arranged so as not to protrude further than an outer shape of a roller that is positioned on an underside of a sheet among the eject roller and the driven roller.

10. The printing apparatus according to claim 1, wherein the movable guide moves to the first position posture after performing the first moving operation.

11. The printing apparatus according to claim 1, wherein the movable guide stops for a predetermined period of time at the second posture, and the predetermined period of time is set in accordance with a type of sheet to be ejected.

12. The printing apparatus according to claim 1, wherein the sheet eject tray is arranged such that the sheet is stacked in an angled state.

13. The printing apparatus according to claim 1, further comprising a movable guide driving mechanism configured to cause the movable guide to move.

14. The printing apparatus according to claim 13, wherein a plurality of movable guides are arranged in a width direction of a sheet and the driving mechanism concurrently drives the plurality of movable guides.

15. The printing apparatus according to claim 13, wherein the movable guide comprises an elastic member that allows an amount of movement of a tip of the movable guide to be different with respect to an amount of driving by the driving mechanism.

16. The printing apparatus according to claim 13, wherein the driving mechanism comprises a driving motor, a series of gears and a torque limiter arranged in the series of gears and that slips when a load greater than or equal to a predetermined torque is applied.

17. The printing apparatus according to claim 16, further comprising a one-way clutch between the torque limiter and a gear connected to the torque limiter and that is configured to break connection with the torque limiter when the gear is rotated in a direction that moves the movable guide to a protruding state and maintains the connection with the torque limiter when the gear is rotated in a direction that moves the movable guide to a retracted state.

18. The printing apparatus according to claim 1, further comprising an eject roller driving mechanism, wherein the eject roller driving mechanism stops driving of the eject roller before the movable guide moves to the second posture and restarts driving of the eject roller after the movable guide stops in the second posture.

19. The printing apparatus according to claim 1, further comprising a controller configured to control a posture of the movable guide, wherein the controller controls the movable guide to perform the first moving operation in a case where a printing condition is a first condition, and controls the movable guide to perform a second moving operation in which the movable guide moves from the first posture to the away posture after the upstream end of the sheet with respect to the first direction is conveyed by the eject roller and thereafter the movable guide does not stop at the second posture in a case where the printing condition is a second condition different from the first condition.

20. The printing apparatus according to claim 19, wherein the printing condition relates to a type of the sheet and an amount of ink applied to the sheet.

* * * * *